US012041988B2

(12) United States Patent
Lamoncha

(10) Patent No.: US 12,041,988 B2
(45) Date of Patent: Jul. 23, 2024

(54) PROTECTIVE FACE MASK FOR ATTACHMENT TO PROTECTIVE EYE-WARE

(71) Applicant: Mark Lamoncha, Columbiana, OH (US)

(72) Inventor: Mark Lamoncha, Columbiana, OH (US)

( * ) Notice: Subject to any disclaimer, the term of this patent is extended or adjusted under 35 U.S.C. 154(b) by 682 days.

(21) Appl. No.: 17/018,354

(22) Filed: Sep. 11, 2020

(65) Prior Publication Data

US 2021/0401084 A1 Dec. 30, 2021

Related U.S. Application Data

(60) Provisional application No. 63/044,751, filed on Jun. 26, 2020.

(51) Int. Cl.
*A41D 13/11* (2006.01)

(52) U.S. Cl.
CPC ..... *A41D 13/1161* (2013.01)

(58) Field of Classification Search
CPC ..... A41D 13/1184; A41D 13/1161; A41D 13/113; A62B 18/082; A61F 9/029; A61F 9/04; A61F 9/045; G02C 11/00
See application file for complete search history.

(56) References Cited

U.S. PATENT DOCUMENTS 2,388,626 A 11/1945 Wilson
2,393,955 A 2/1946 Baratelli et al.
2,574,749 A 11/1951 Mendelsohn
2,774,970 A * 12/1956 Du Bois ..... A41D 13/1184 2/9
3,298,031 A 1/1967 Morgan
3,531,188 A 9/1970 LeBlanc et al.
3,991,753 A * 11/1976 Viesca y Viesca .. A62B 18/082 351/158
4,231,364 A 11/1980 Speshyock
4,280,491 A 7/1981 Berg et al.
4,764,167 A 8/1988 Tu
4,790,306 A 12/1988 Braun et al.
(Continued)

FOREIGN PATENT DOCUMENTS

DE 202020102697 U1 * 7/2020 ..... A41D 13/1184

OTHER PUBLICATIONS

ChicMe, Face Mask with Clear Window Visible Expression for the Deaf and Hard of Hearing, site visited Aug. 19, 2020, https://www.chicme.com/product/face_mask_with_clear_window_visible_expression_for_the_deaf_and_hard_of_hearing/7a76007a-3d75-4f4f-b443-f2a8cb6d0db0.html.
(Continued)

*Primary Examiner* — Aiying Zhao
(74) *Attorney, Agent, or Firm* — Standley Law Group LLP; Jeffrey S. Standley; Adam J. Smith

(57) ABSTRACT

A strapless, personal protective face mask that includes glasses, a nosepiece, and a mouth covering is described. The glasses are configured to be worn by a user and includes a bridge. The face mask may include a nosepiece having a curved body, an attachment portion disposed along the top of the body, and an attachment feature configured to securely attach the nosepiece to, for example, the bridge of the glasses. The mouth covering extends from the bottom of the body and covers at least a majority of the user's mouth. An embodiment having a transparent shield over the zone about a user's mouth is also described.

9 Claims, 48 Drawing Sheets

(56) References Cited

U.S. PATENT DOCUMENTS

| | | | | |
|---|---|---|---|---|
| 4,796,621 | A | 1/1989 | Barle et al. | |
| 4,821,340 | A | 4/1989 | Johnson | |
| 4,832,018 | A | 5/1989 | Pantaleon-Stemberg | |
| 4,843,643 | A * | 7/1989 | Parissenti | A41D 13/1184 351/158 |
| 4,850,346 | A | 7/1989 | Michel et al. | |
| 4,924,526 | A * | 5/1990 | Parissenti | A61F 9/029 2/9 |
| 4,934,361 | A | 6/1990 | Michel et al. | |
| 4,965,887 | A | 10/1990 | Paoluccio et al. | |
| 5,062,421 | A | 11/1991 | Burns et al. | |
| 5,086,768 | A | 2/1992 | Niemeyer | |
| 5,167,036 | A * | 12/1992 | Daprato | G02C 5/12 2/13 |
| 5,181,507 | A | 1/1993 | Michel et al. | |
| 5,206,956 | A * | 5/1993 | Olson | G02C 7/16 128/857 |
| 5,240,478 | A | 8/1993 | Messina | |
| 5,247,706 | A * | 9/1993 | Mark | A61F 9/025 2/427 |
| 5,265,595 | A | 11/1993 | Rudolph | |
| H1316 | H | 6/1994 | McGuinness | |
| 5,331,957 | A | 7/1994 | Liui | |
| 5,392,773 | A | 2/1995 | Bertrand | |
| 5,416,923 | A | 5/1995 | Peugh | |
| 5,463,693 | A | 10/1995 | Birli et al. | |
| 5,471,679 | A * | 12/1995 | Paoluccio | G02C 11/00 2/9 |
| 5,505,197 | A | 4/1996 | Scholey | |
| 5,765,223 | A | 6/1998 | McCausland | |
| 5,957,131 | A | 9/1999 | Hutchinson et al. | |
| 5,996,580 | A | 12/1999 | Swann | |
| 6,016,808 | A | 1/2000 | Landis | |
| 6,298,849 | B1 | 10/2001 | Scholey et al. | |
| 6,408,845 | B1 | 6/2002 | Pereira et al. | |
| 6,497,232 | B2 | 12/2002 | Fecteau et al. | |
| 6,497,756 | B1 | 12/2002 | Curado et al. | |
| 6,536,435 | B1 | 3/2003 | Fecteau et al. | |
| 6,543,450 | B1 | 4/2003 | Flynn | |
| 6,584,975 | B1 | 7/2003 | Taylor | |
| 6,604,524 | B1 | 8/2003 | Curran et al. | |
| 6,684,882 | B1 | 2/2004 | Morine | |
| 6,758,212 | B2 | 7/2004 | Swann | |
| 6,763,835 | B1 | 7/2004 | Grove et al. | |
| 6,957,653 | B2 | 10/2005 | Campbell et al. | |
| 6,959,709 | B2 | 11/2005 | Curran et al. | |
| 7,007,695 | B2 | 3/2006 | Curran et al. | |
| 7,082,944 | B2 | 8/2006 | Gossweiler | |
| 7,188,623 | B2 | 3/2007 | Anderson et al. | |
| 7,294,175 | B2 | 11/2007 | Huang et al. | |
| 7,594,278 | B2 | 9/2009 | Huh | |
| 7,878,202 | B2 | 2/2011 | Anderson et al. | |
| 8,192,523 | B1 | 6/2012 | Kaufman et al. | |
| 8,211,226 | B2 | 7/2012 | Bredt et al. | |
| 8,291,512 | B2 | 10/2012 | Stoll | |
| 9,084,416 | B2 | 7/2015 | Steen et al. | |
| 9,192,793 | B2 | 11/2015 | Patil et al. | |
| 9,192,796 | B2 | 11/2015 | Patil et al. | |
| 9,408,424 | B2 | 8/2016 | Noh et al. | |
| 9,468,782 | B2 | 10/2016 | Koehler | |
| 9,596,842 | B2 | 3/2017 | Steen et al. | |
| 10,207,129 | B2 | 2/2019 | Koehler | |
| 10,213,629 | B2 | 2/2019 | Tobias | |
| 10,556,136 | B2 | 2/2020 | Seppala et al. | |
| 10,881,157 | B1 * | 1/2021 | Anderson | A41D 13/1107 |
| 11,533,958 | B1 | 12/2022 | Spinnato | |
| 11,559,652 | B2 | 1/2023 | Oddo | |
| 2002/0078953 | A1 | 6/2002 | Fecteau et al. | |
| 2004/0007234 | A1 | 1/2004 | Duxbury | |
| 2004/0025878 | A1 | 2/2004 | Duxbury | |
| 2004/0237962 | A1 | 12/2004 | Russell | |
| 2005/0051169 | A1 | 3/2005 | Gossweiler | |
| 2005/0150385 | A1 | 7/2005 | Huang et al. | |
| 2006/0005841 | A1 | 1/2006 | Anderson et al. | |
| 2006/0081249 | A1 | 4/2006 | Duxbury | |
| 2006/0201513 | A1 | 9/2006 | Chu | |
| 2006/0207605 | A1 | 9/2006 | Anderson et al. | |
| 2007/0240719 | A1 | 10/2007 | Duarte | |
| 2008/0223370 | A1 | 9/2008 | Kim | |
| 2010/0065058 | A1 | 3/2010 | Ungar et al. | |
| 2012/0184024 | A1 | 7/2012 | Steen et al. | |
| 2014/0116430 | A1 | 5/2014 | Patil et al. | |
| 2014/0283842 | A1 | 9/2014 | Bearne et al. | |
| 2015/0020800 | A1 | 1/2015 | Tobias | |
| 2015/0053206 | A1 | 2/2015 | Seppala et al. | |
| 2015/0173953 | A1 * | 6/2015 | Wang | A61F 9/025 128/858 |
| 2015/0342178 | A1 | 12/2015 | Steen et al. | |
| 2016/0001101 | A1 | 1/2016 | Sabolis et al. | |
| 2016/0213959 | A1 | 7/2016 | Barklow | |
| 2016/0332008 | A1 | 11/2016 | McAndrews | |
| 2017/0273626 | A1 | 9/2017 | MacDonald | |
| 2017/0361531 | A1 | 12/2017 | Hasskerl et al. | |
| 2019/0126542 | A1 | 5/2019 | Poppe et al. | |
| 2019/0127598 | A1 | 5/2019 | Bernhardt et al. | |
| 2019/0255370 | A1 | 8/2019 | Seppala et al. | |
| 2019/0299520 | A1 | 10/2019 | Wieber et al. | |
| 2019/0321663 | A1 | 10/2019 | Nestelroad et al. | |
| 2020/0108218 | A1 | 4/2020 | Bock-Aronson et al. | |
| 2021/0275842 | A1 | 9/2021 | Conrad | |
| 2021/0319777 | A1 | 10/2021 | Wang | |
| 2021/0345703 | A1 | 11/2021 | Sheldon | |
| 2021/0392973 | A1 | 12/2021 | Whitehead | |
| 2022/0258236 | A1 | 8/2022 | Andrews | |

OTHER PUBLICATIONS

ClearMask, The ClearMask, site visited Aug. 19, 2020, https://www.theclearmask.com/product.

Etsy, site visited Aug. 19, 2020, https://www.etsy.com/market/clear_mask.

FilterSpec, Filterspec PRO Goggle FFP3V Valved, site visited Aug. 19, 2020, https://www.jspsafety.com/link/en/respiratory-protection/filterspec-integrated-protection/filterspec-pro/filterspec-pro-goggle-ffp3v-valved/age130-201-100/p/?parm=CAT1JSP&prdcod=AGE130-201-100.

Good Housekeeping, Where to Buy Clear Face Masks with Windows for Lip Reading, site visited Aug. 19, 2020, https://www.goodhousekeeping.com/health/g33471599/best-clear-face-masks/.

Jackson Safety, Jackson Safety 18629 V90 Goggle and Faceshield, Standard, Clear with Blue Tint, site visited Aug. 19, 2020, https://www.amazon.com/Jackson-Safety-18629-Faceshield-Standard/dp/B00KTEM046.

Unique Gadgets & Toys, Safety Face Shield Reusable Goggle Shield Wearing Glasses Face Visor Transparent Anti-Fog Layer Protect Eyes from Splash, site visited Aug. 19, 2020, https://www.amazon.com/Reusable-Wearing-Glasses-Transparent-Anti-Fog/dp/B087F2CNKH/ref=sr_1_6?dchild=1&keywords=Unique+Gadgets+%26+Toys&qid=1603913032&sr=8-6.

Additive Manufacturing, 3D Printing and Coronavirus: U.S. Additive Manufacturers Share Their Experiences, May 19, 2020, https://www.additivemanufacturing.media/blog/post/3d-printing-and-coronavirus-us-additive-manufacturers-share-their-experiences.

* cited by examiner

PROTECTIVE FACE MASK FOR ATTACHMENT TO PROTECTIVE EYE-WARE

CROSS-REFERENCE TO RELATED APPLICATIONS

This application is a nonprovisional patent application and makes a priority claim to U.S. Provisional Application No. 63/044,751, filed Jun. 26, 2020.

TECHNICAL FIELD

The application relates to face masks and, more particularly, to face masks that cover the user's eyes, nose, and mouth.

BACKGROUND OF THE INVENTION

Face masks are a type of personal protective equipment (PPE) that is commonly worn by a user to protect the user from harmful, or otherwise undesired, foreign particulate matter. This may include, for example, pathogens (e.g., viruses, bacteria, fungus, etc.), dust, pollen, soot, smoke, and liquid droplets. In effect, face masks may also prevent the spread of particulate matter (e.g., respirable particulate matter) from the user to the user's environment.

The global COVID-19 pandemic has elevated the importance of wearing PPE, especially in public places. As a result, the global stock of face masks has come into short supply, prompting those in search of PPE to improvise ways of fabricating their own face masks, many of which are ill-fitting or not effective, or to go without. Accordingly, those skilled in the art continue with research and development efforts in the field of PPE.

SUMMARY OF THE INVENTION

Disclosed are face masks that include glasses, nosepieces, and mouth coverings.

In one embodiment, the protective eye-ware of the present invention may comprise glasses configured to be worn by a user and may include a nose bridge. A face mask extends from the glasses and may include a nosepiece preferably having a curved body portion, and an attachment portion disposed along the top of the body portion. The attachment portion may include an attachment feature configured to securely attach the nosepiece to the bridge of the glasses. A mouth covering may extend from the bottom of the body portion and substantially cover the user's mouth.

In another embodiment of the present invention, the attachment feature may include a clip that receives a portion of the bridge. Further, the mouth covering may include a filter portion and an outer edge portion that extends along the perimeter of the filter portion. In yet another embodiment of the present invention, the mouth covering includes a transparent mouth shield within the center of the filter portion to facilitate visibility of mouth movements by the user.

Other examples of the disclosed face mask will become apparent from the following detailed description, the accompanying drawings and the appended claims.

DETAILED DESCRIPTION

Figure 1:
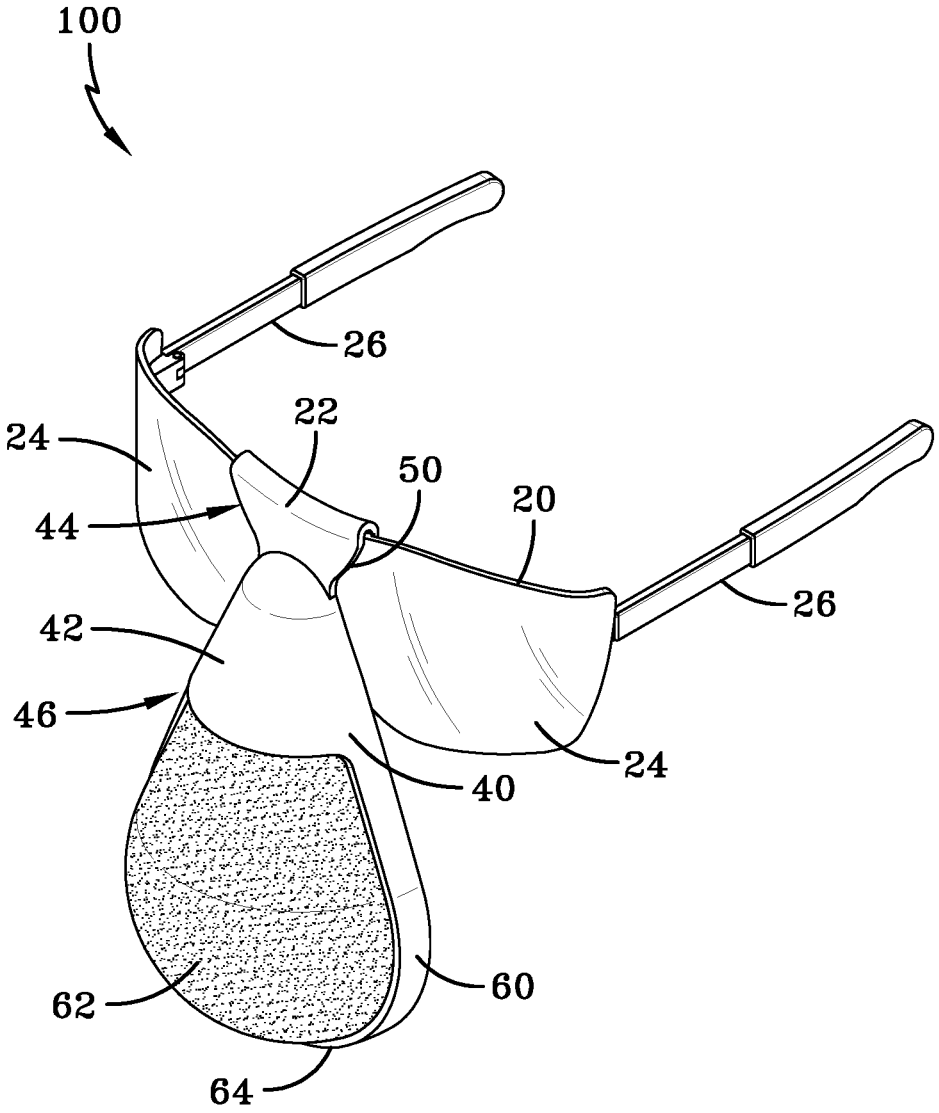
FIG. 1 is a front-perspective view of a first example of the disclosed face mask.
Figure 2:
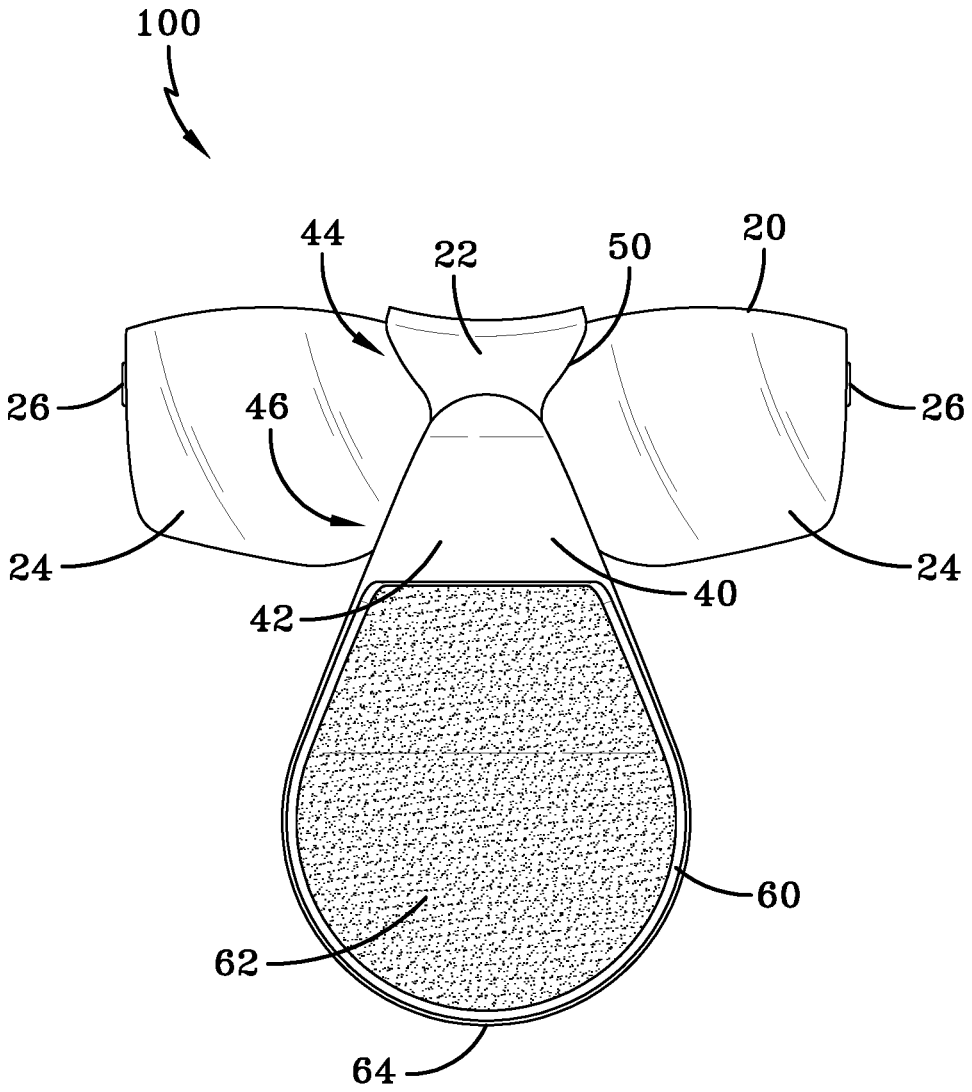
FIG. 2 is a front elevational view of the face mask of FIG. 1.
Figure 3:
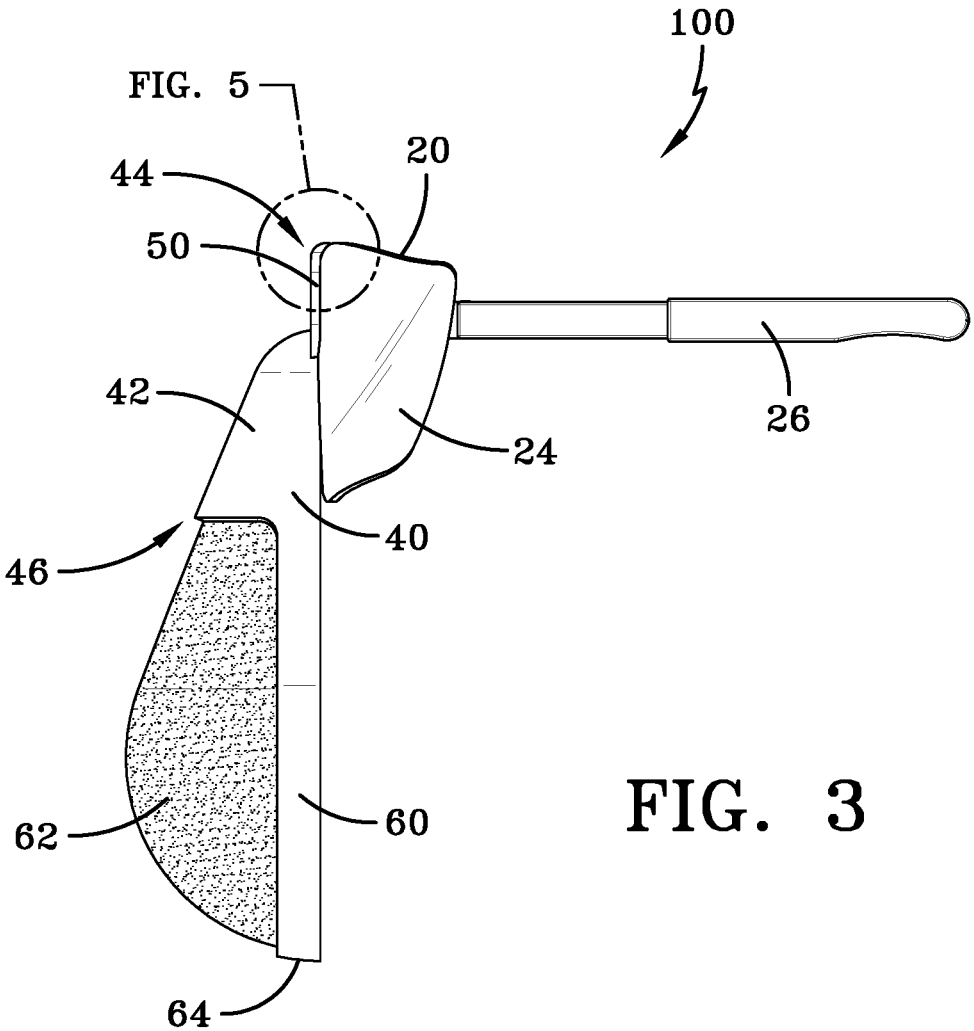
FIG. 3 is a side elevational view of the face mask of FIG. 1.

The following detailed description refers to the accompanying drawings, which illustrate specific examples described by the disclosure. Other examples having different structures and operations do not depart from the scope of the present disclosure. Like reference numerals may refer to the same feature, element, or component in the different drawings.

Illustrative, non-exhaustive examples, which may be, but are not necessarily, claimed, of the subject matter according to the present disclosure are provided below. Reference herein to "example" means that one or more feature, structure, element, component, characteristic and/or operational step described in connection with the example is included in at least one embodiment and/or implementation of the subject matter according to the present disclosure. Thus, the phrase "an example" and similar language throughout the present disclosure may, but do not necessarily, refer to the same example. Further, the subject matter characterizing any one example may, but does not necessarily, include the subject matter characterizing any other example.

Referring to FIGS. 1-13, the present disclosure provides an example of a face mask 100 for protecting the eyes, nose, and mouth of a user. The face mask 100 includes glasses 20 (i.e., "a pair of glasses"), a nosepiece 40, and a mouth covering 60. By putting on the glasses 20, the nosepiece 40 and the mouth covering 60 may be brought into close proximity with the user's nose and mouth, thereby functioning as a barrier to prevent the user from inhaling undesired particulate matter. In this way, the face mask 100 may also prevent the user from spreading his/her own particulate matter to the surrounding environment.

Any structurally sound type of glasses 20 may be utilized. This may include, for example, safety glasses (e.g., "goggles"), prescription eyeglasses, conventional sunglasses, and the like. In preferred embodiments, the glasses 20 may include a bridge 22 (e.g., between the lenses 24) that, as discussed below, may facilitate the attachment of the nosepiece 40.

The nosepiece 40 includes a body 42 and an attachment portion 50 disposed along the top 44 of the body 42. The attachment portion 50 further includes an attachment feature 52 that enables the nosepiece 40 to be attached to the glasses 20. As shown, the attachment portion 50 may be configured to overlay on top of the glasses 20, along the center. The attachment portion 50 may be curved inwards along the vertical dimension of the attachment portion 50 so as to minimize, if not eliminate, any obstruction to the user's vision. Further, considering as how glasses 20 of varying dimensions may be used, it is generally contemplated that the size and shape of the attachment portion 50, including the attachment feature 52, may also vary commensurate with the dimensions of the glasses 20 actually used.

The nosepiece 40 may be fabricated out of any suitable material such as, for example, acrylonitrile butadiene styrene (ABS), thermoplastic elastomers (TPE), polylactic acid (PLA), high impact polystyrene (HIPS), polyethylene terephthalate glycol (PET), nylon, carbon fiber, acrylonitrile styrene acrylate (ASA), polycarbonate, polypropylene, metal, wood, poly(vinyl alcohol) (PVA), combinations thereof, and/or the like.

Figure 5:
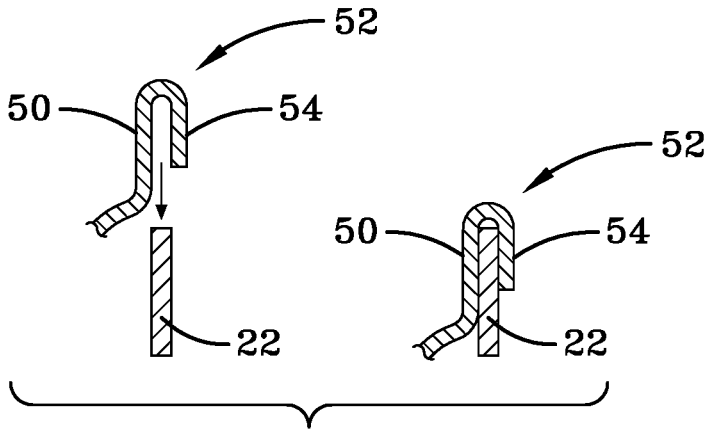
FIG. 5 is a cross-sectional view of the attachment portion of the face mask of FIG. 1 being attached to the bridge of a pair of glasses.
Figure 4:
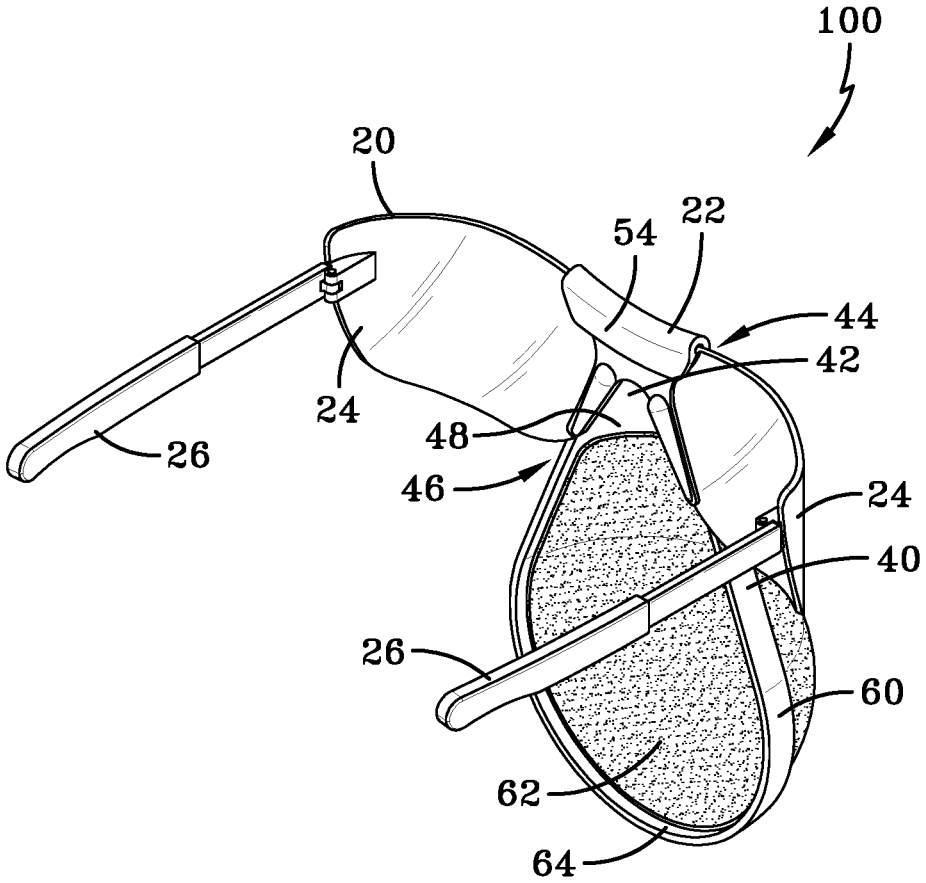
FIG. 4 is a rear-perspective view of the face mask of FIG. 1.
Figure 6:
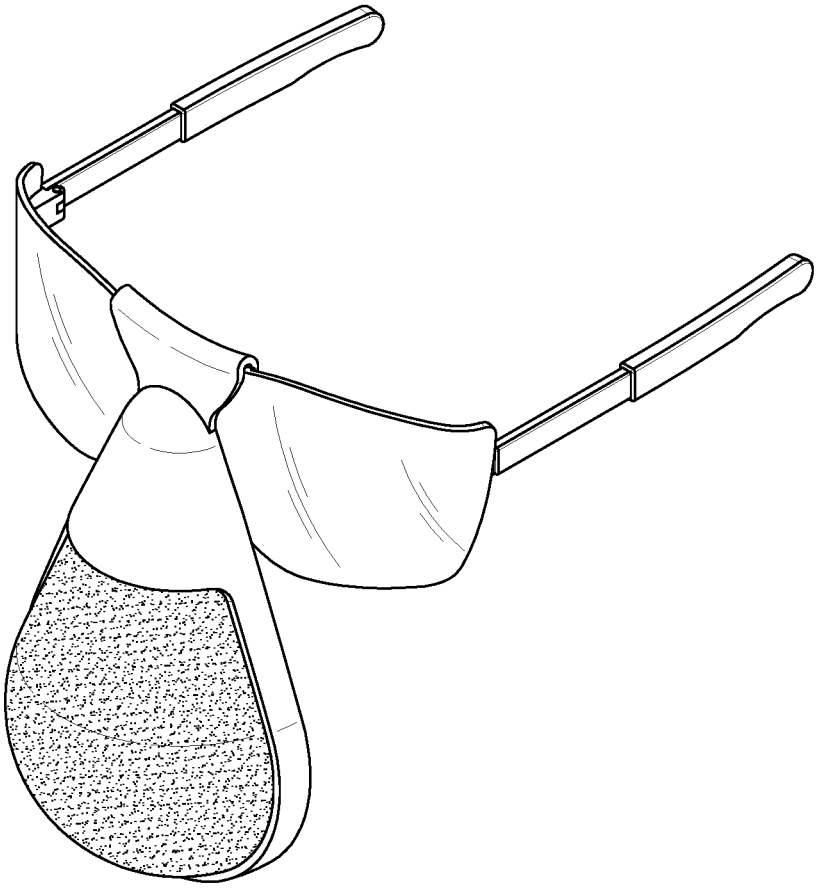
FIG. 6 is a front-perspective view of the face mask of FIG. 1.
Figure 7:
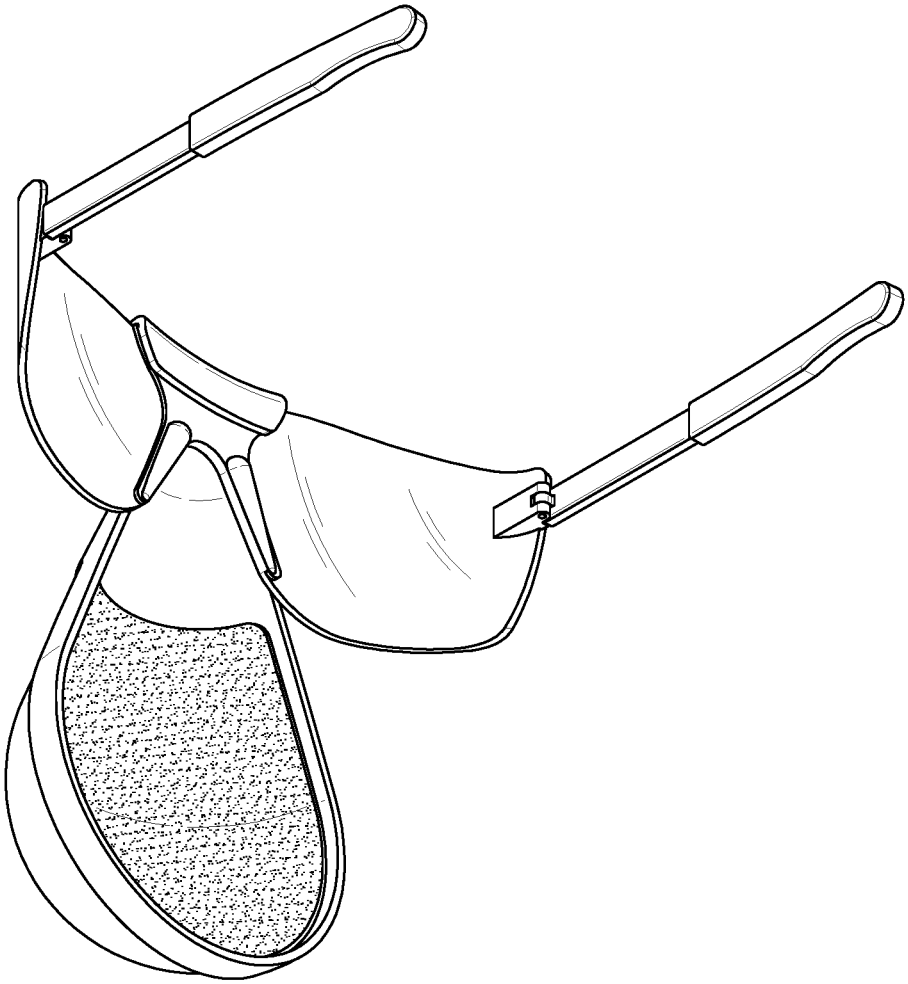
FIG. 7 is a rear-perspective view of the face mask of FIG. 6.
Figure 8:
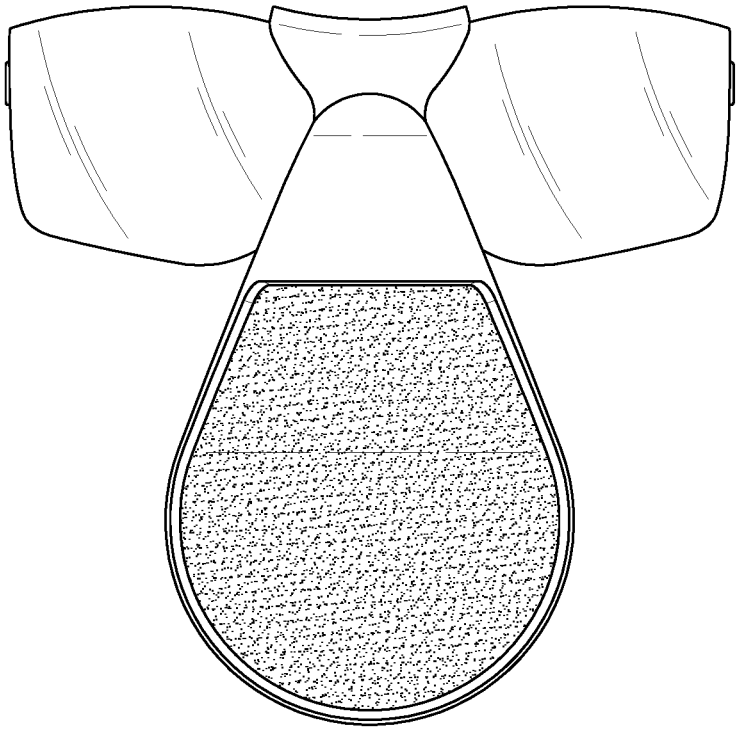
FIG. 8 is a front elevational view of the face mask of FIG. 6.
Figure 9:
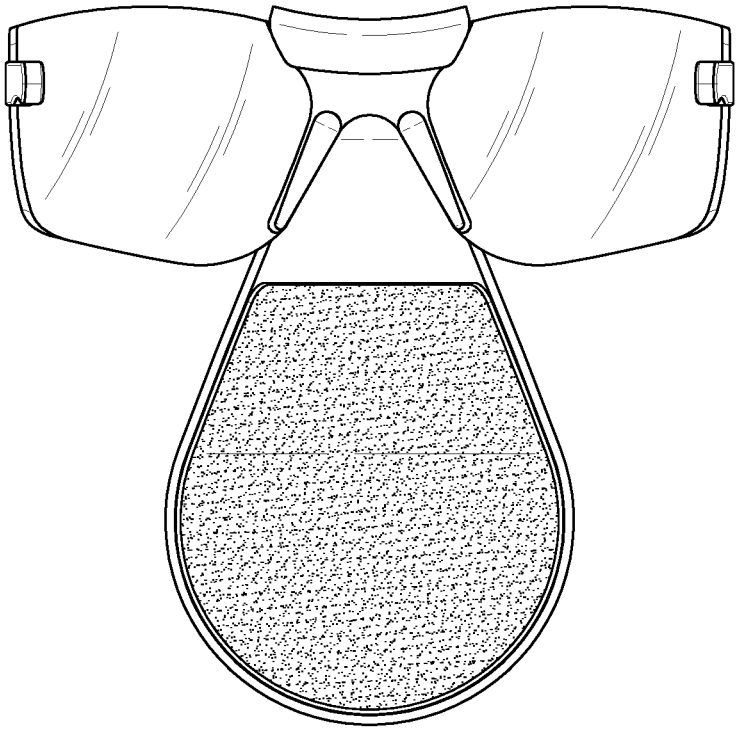
FIG. 9 is a rear elevational view of the face mask of FIG. 6.
Figure 10:
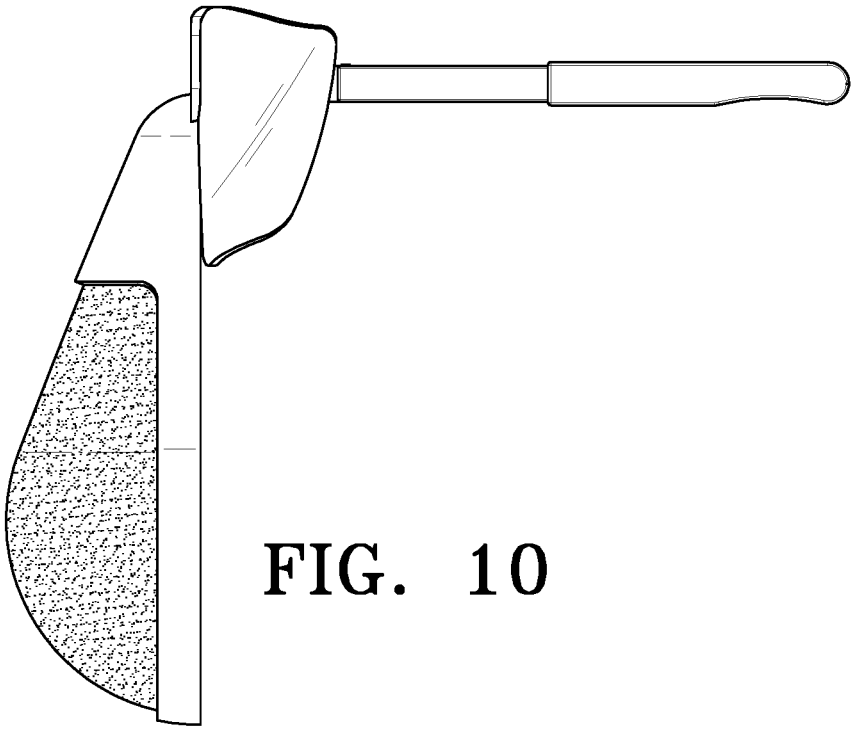
FIG. 10 is a right-side elevational view of the face mask of FIG. 6.
Figure 11:
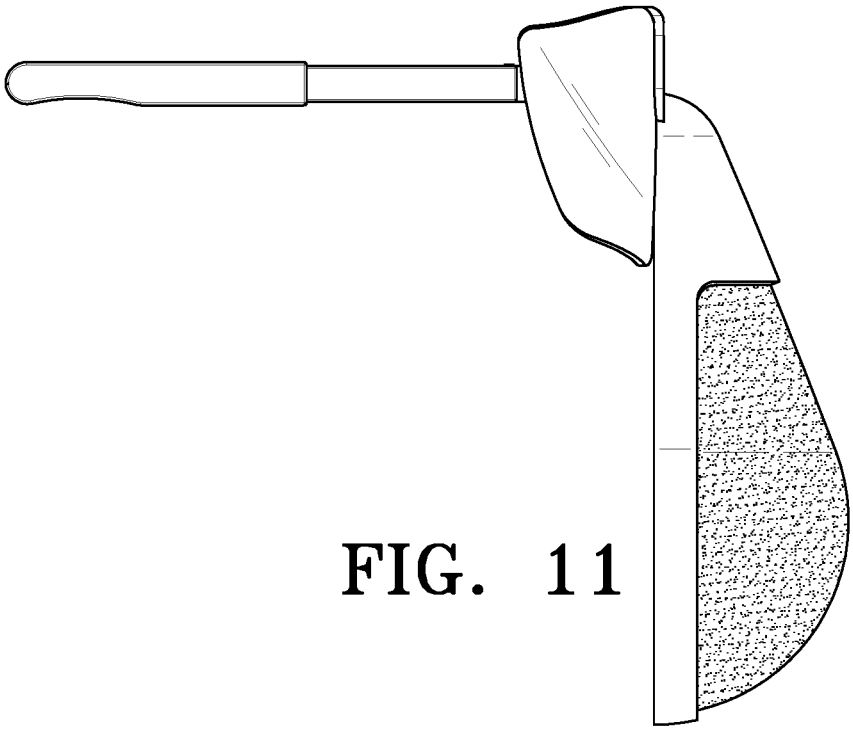
FIG. 11 Is a left-side elevational view of the face mask of FIG. 6.
Figure 12:
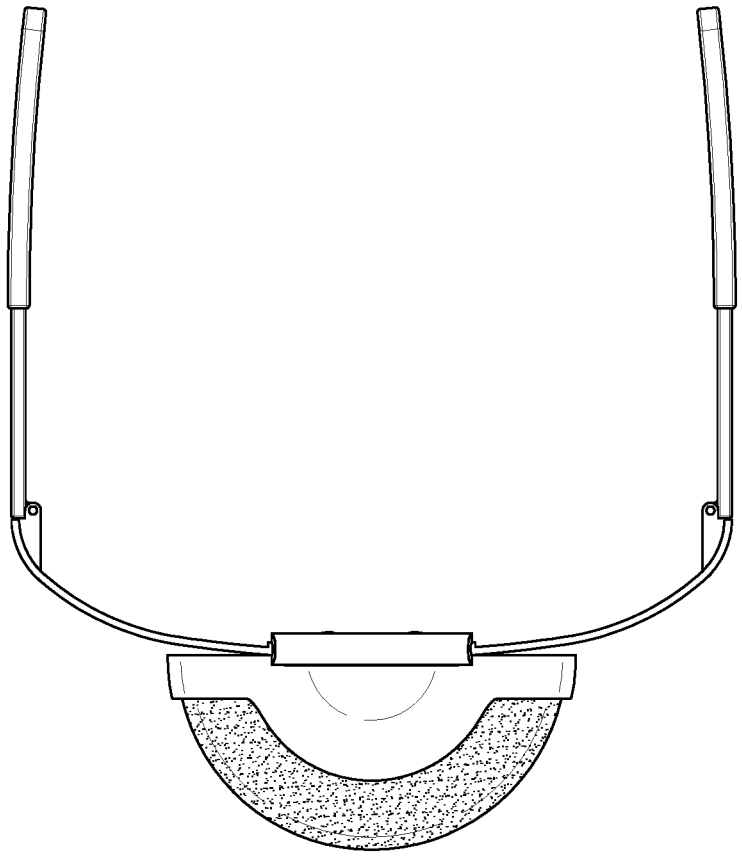
FIG. 12 is a top plan view of the face mask of FIG. 6.
Figure 13:
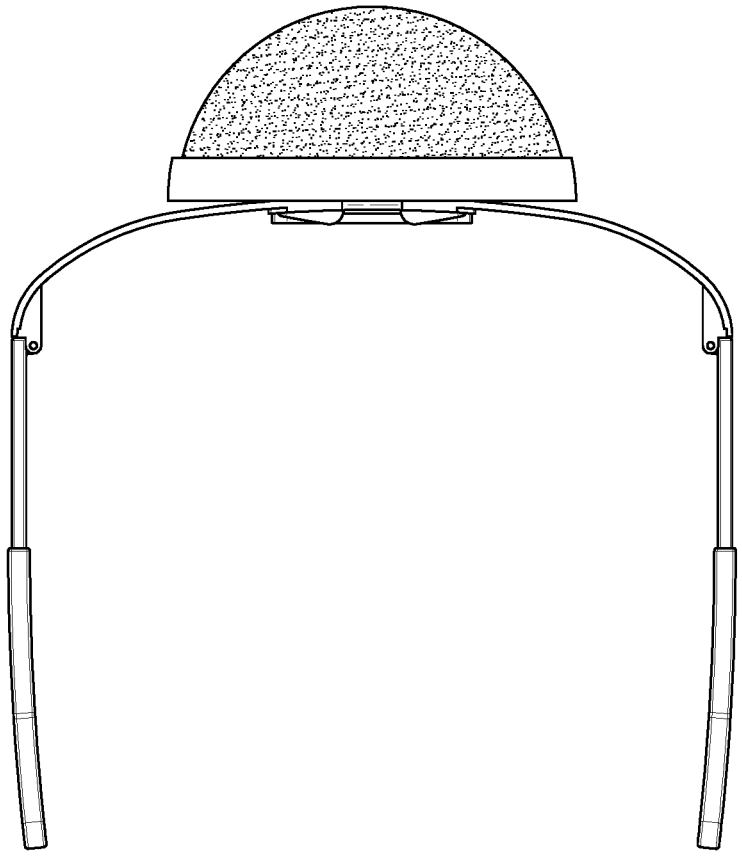
FIG. 13 is a bottom view of the face mask of FIG. 6.
Figure 14:
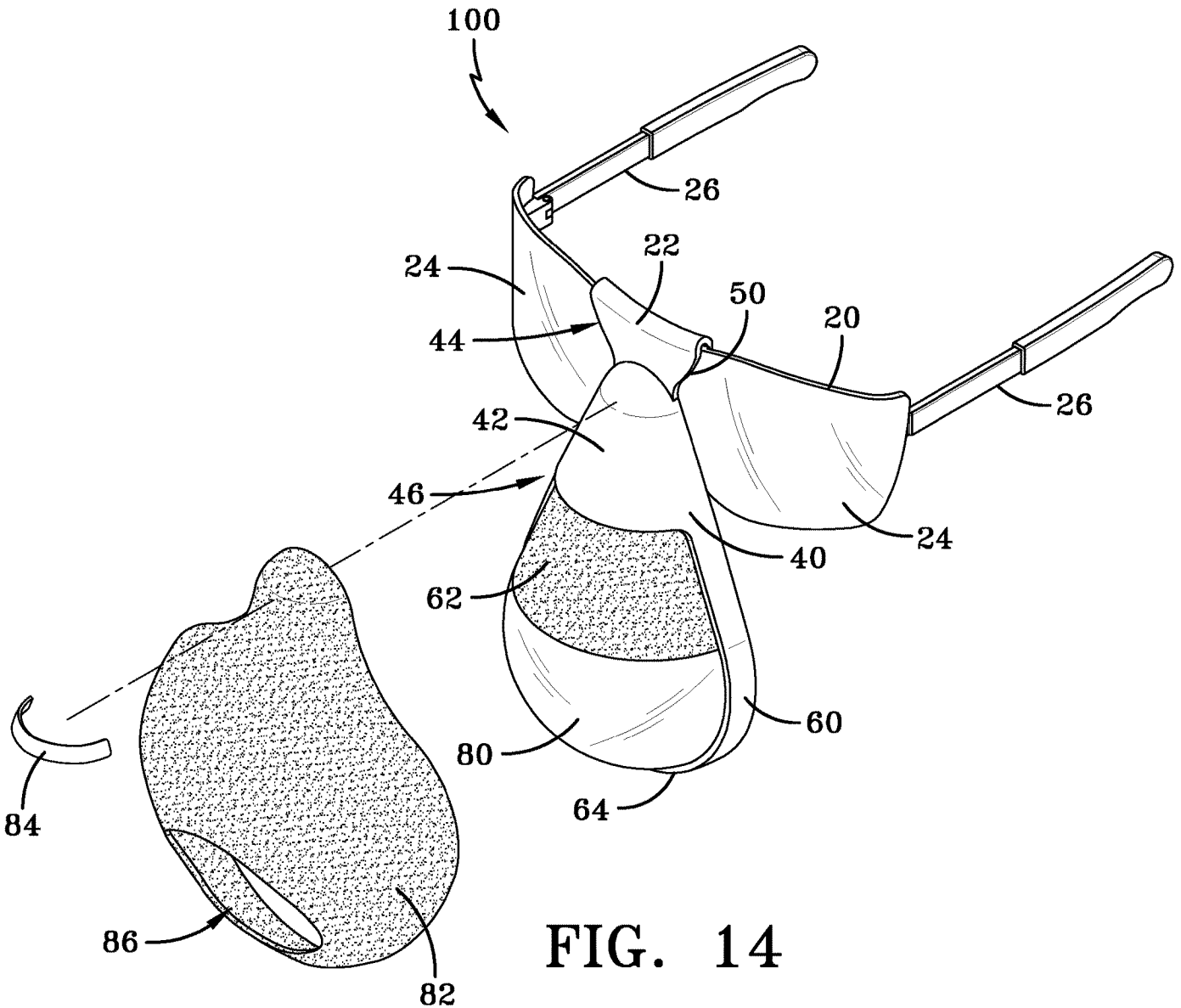
FIG. 14 is an exploded top-perspective view of an alternative embodiment of the face mask of FIG. 1 that includes a conventional face mask and a metallic clip.
Figure 15:
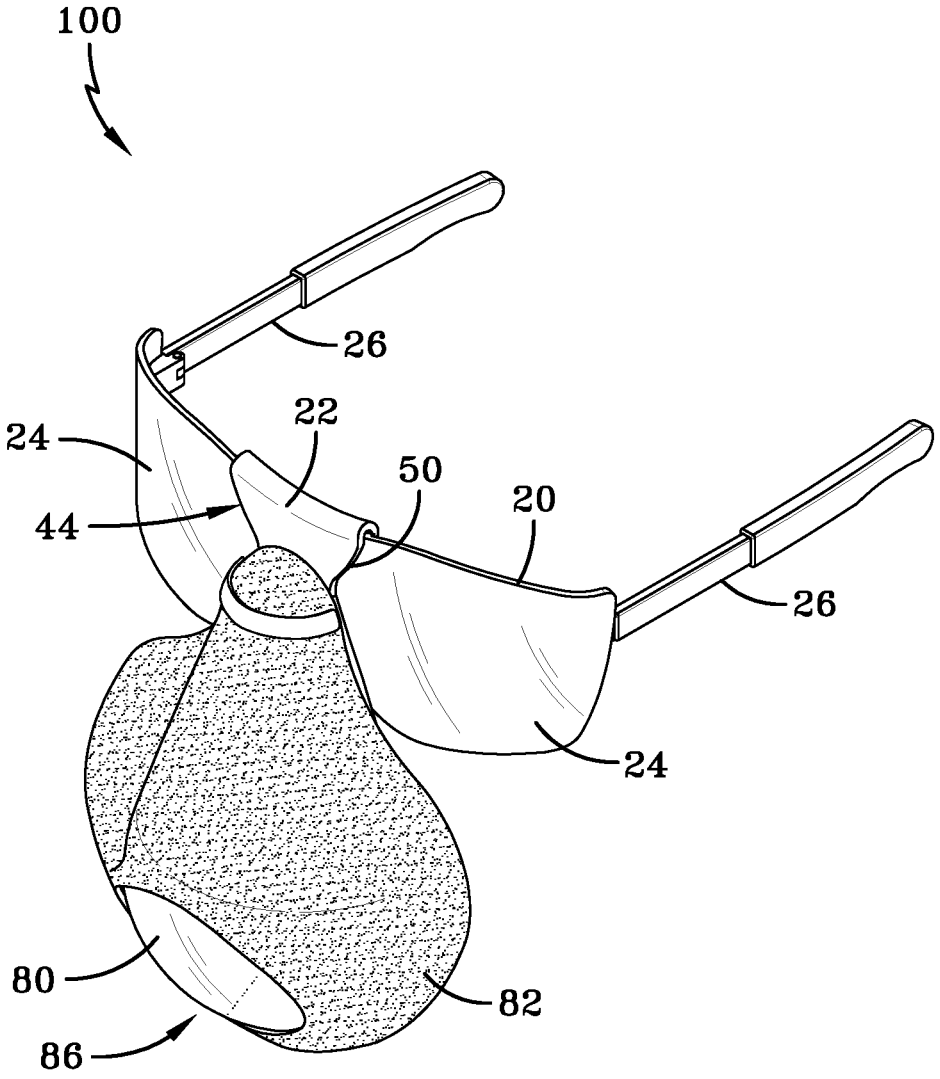
FIG. 15 is top-perspective view of the face mask of FIG. 14.
Figure 16:
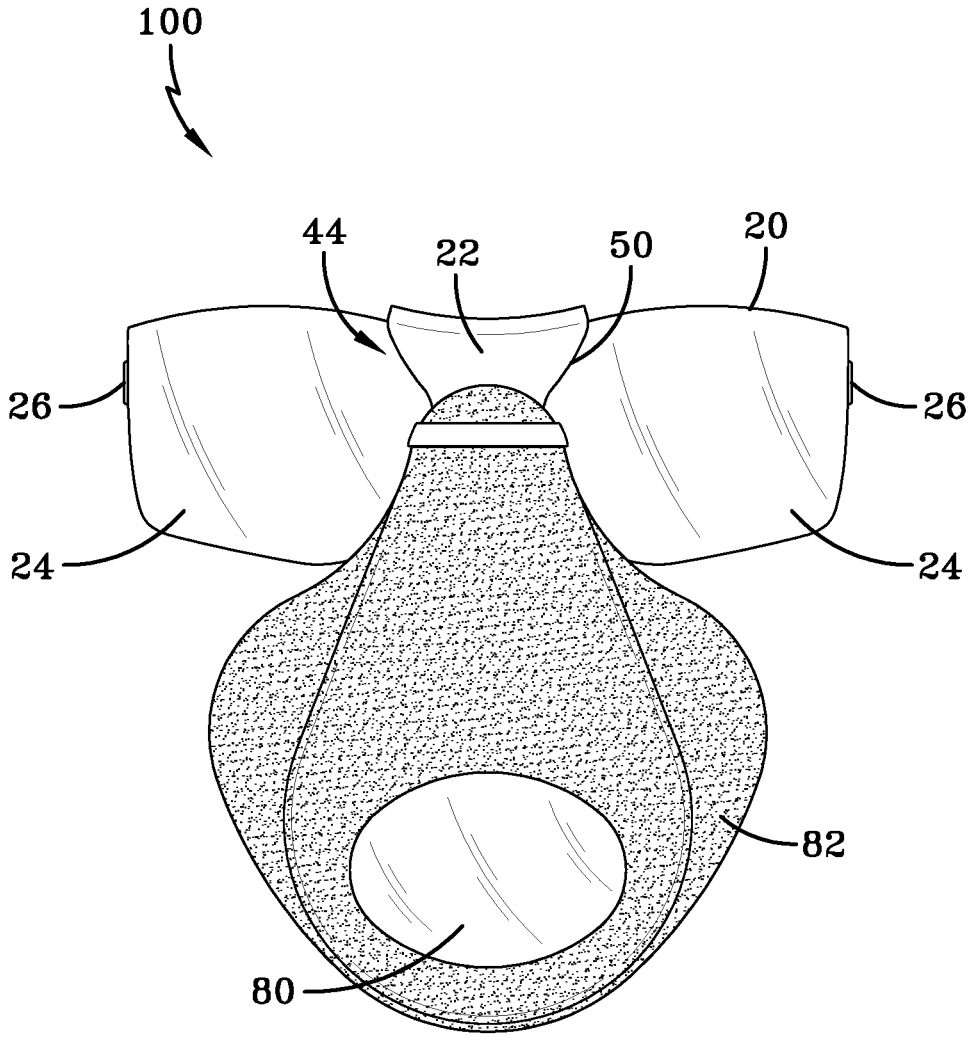
FIG. 16 is a front elevational view of the face mask of FIG. 14.
Figure 17:
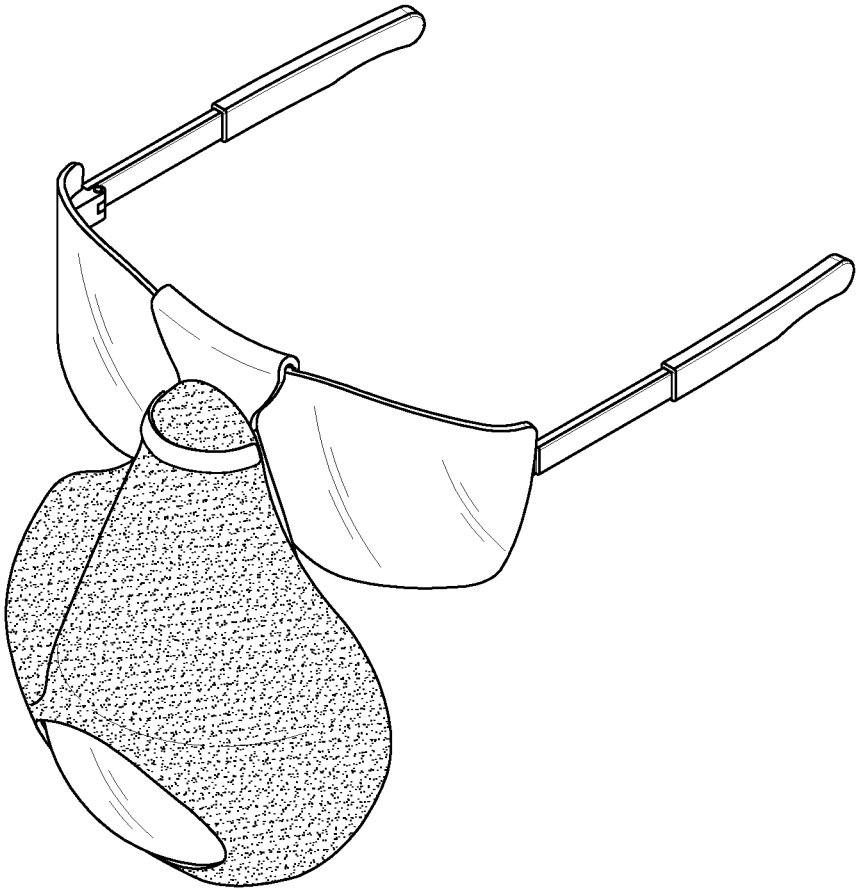
FIG. 17 is a front-perspective view of the face mask of FIG. 14.
Figure 18:
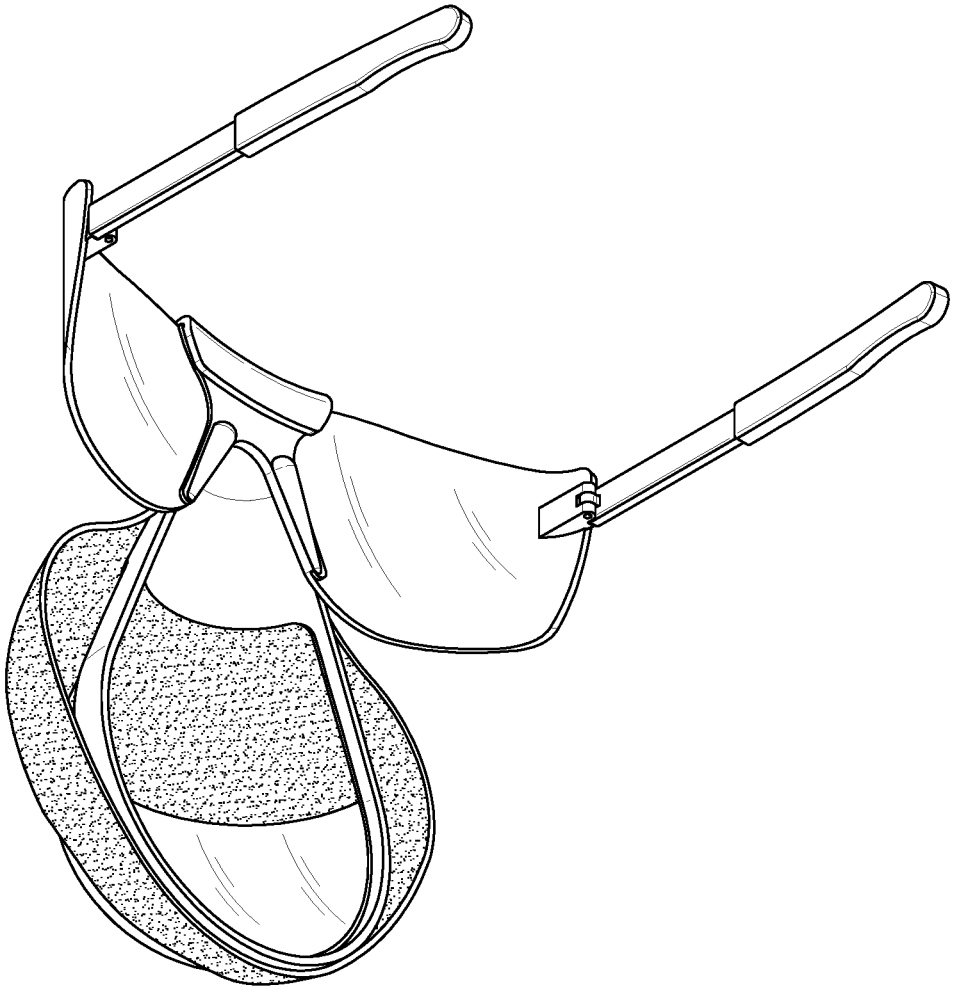
FIG. 18 is a rear-perspective view of the face mask of FIG. 17.
Figure 19:
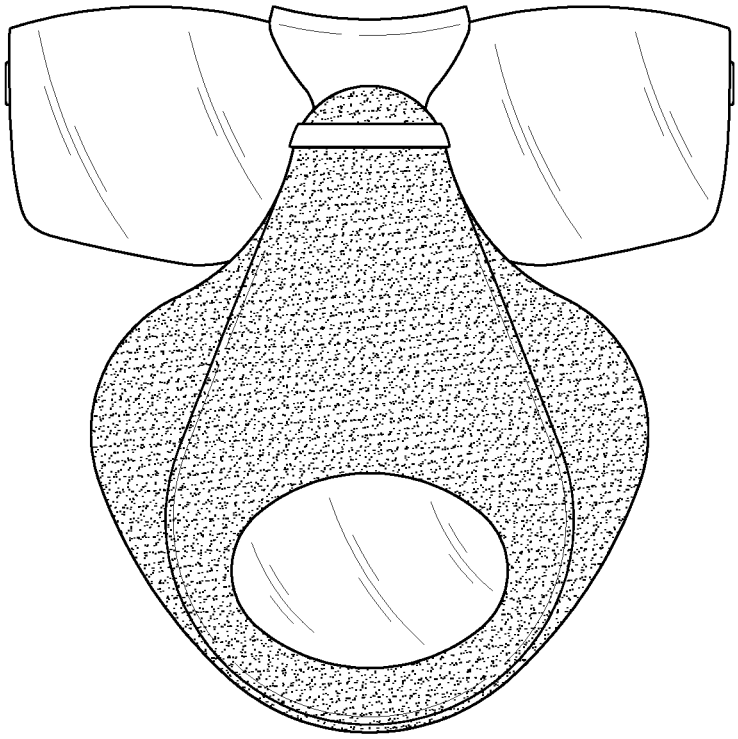
FIG. 19 is a front elevational view of the face mask of FIG. 17.
Figure 20:
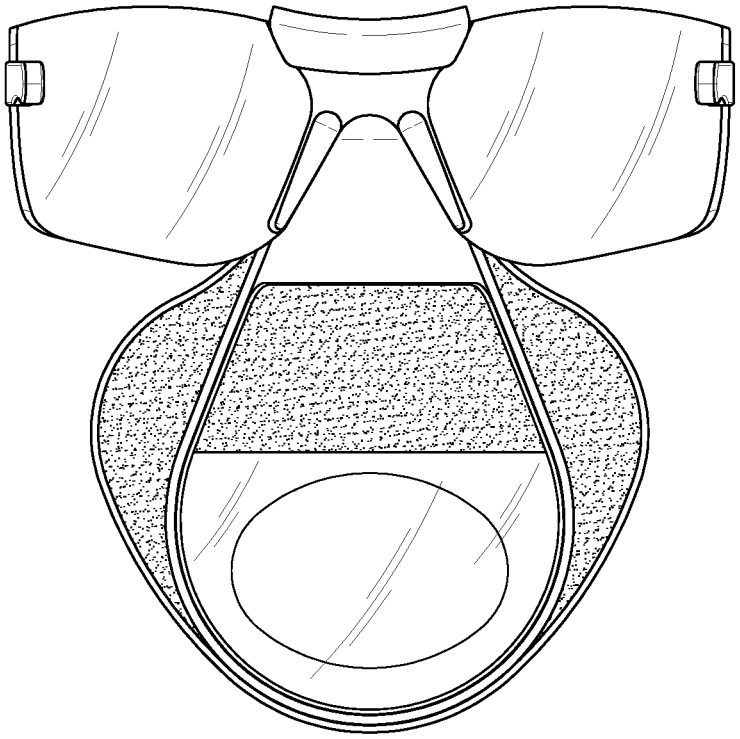
FIG. 20 is a rear elevational view of the face mask of FIG. 17.
Figure 21:
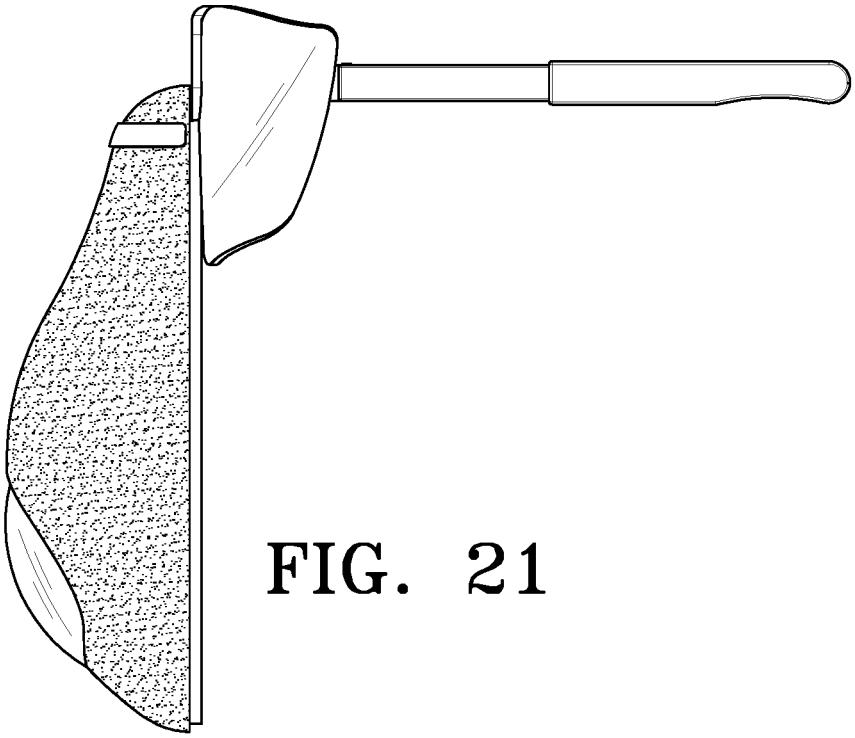
FIG. 21 is a right-side elevational view of the face mask of FIG. 17.
Figure 22:
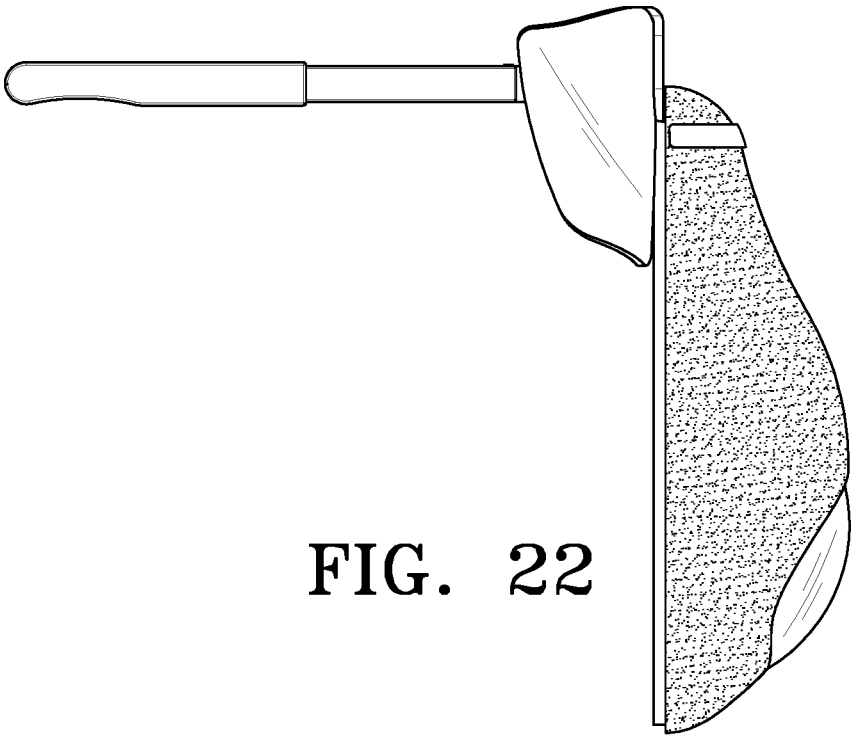
FIG. 22 Is a left-side elevational view of the face mask of FIG. 17.
Figure 23:
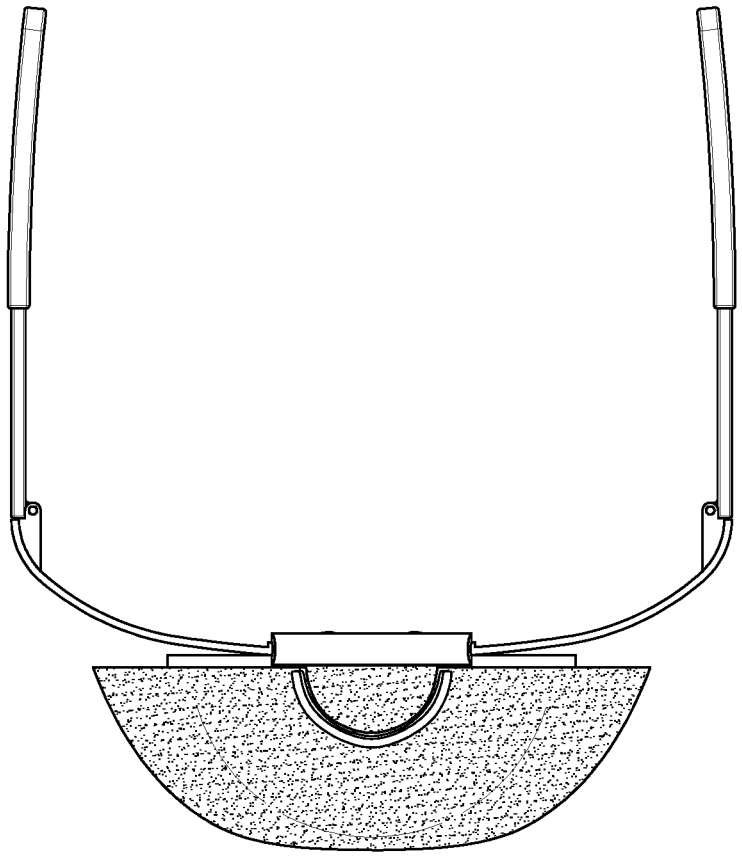
FIG. 23 is a top plan view of the face mask of FIG. 17.
Figure 24:
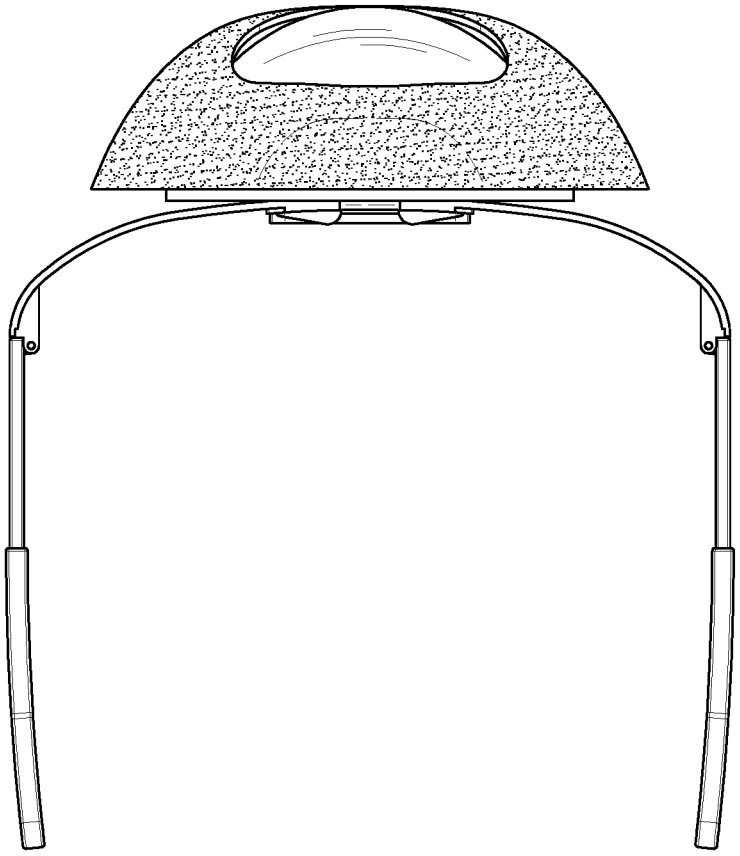
FIG. 24 is a bottom view of the face mask of FIG. 17.
Figure 25:
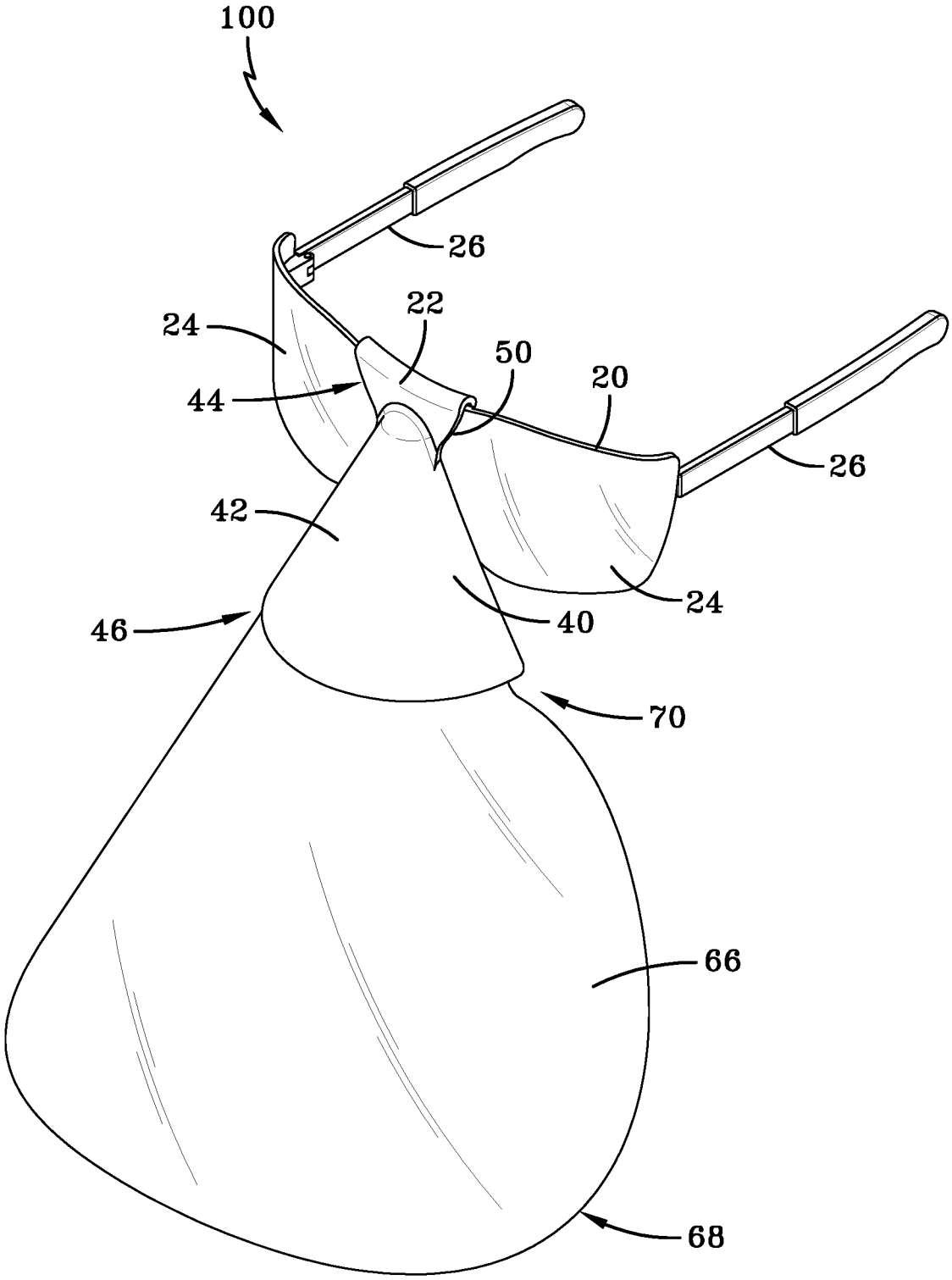
FIG. 25 is a front-perspective view of a second example of the disclosed face mask.
Figure 26:
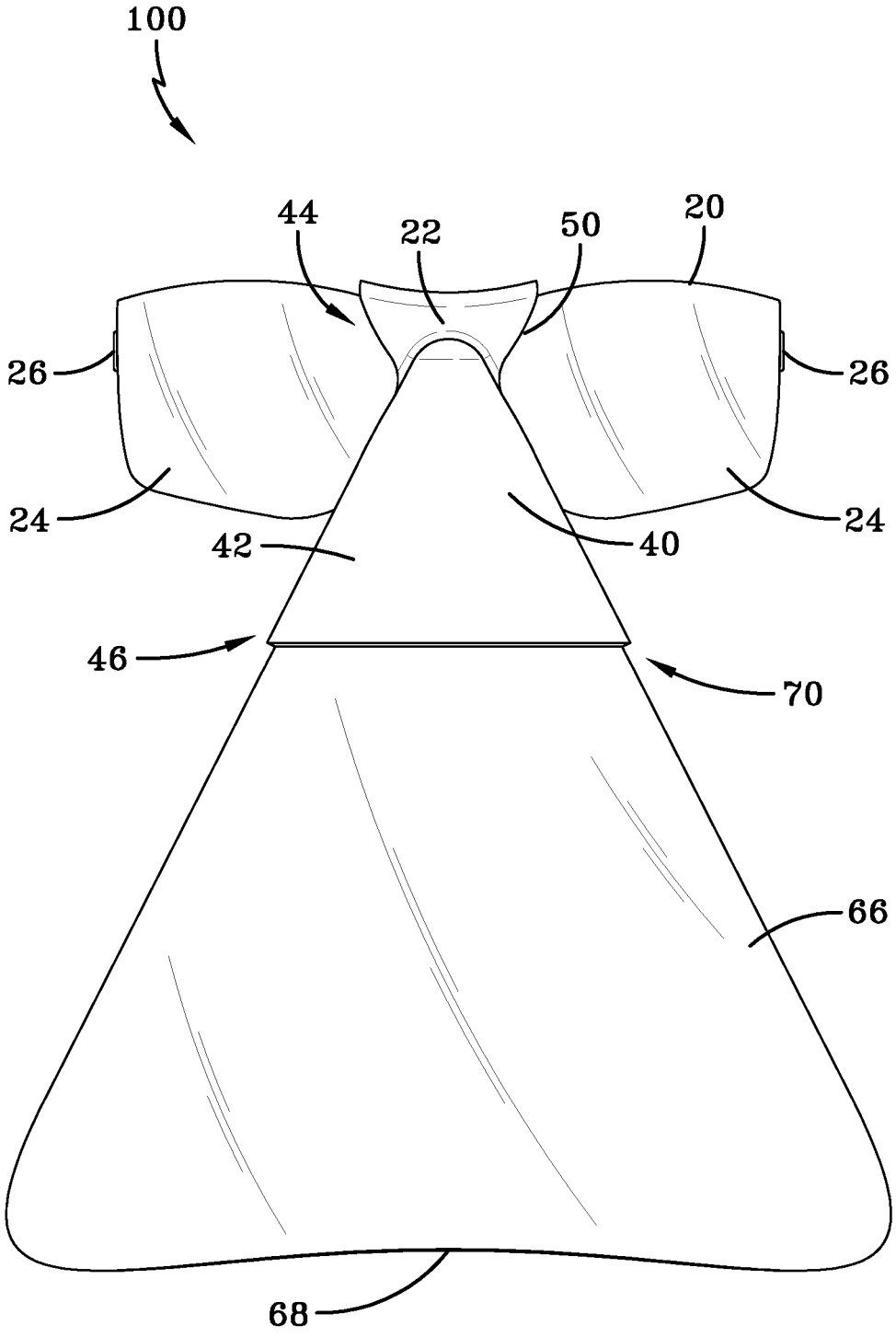
FIG. 26 is a front elevational view of the face mask of FIG. 25.
Figure 27:
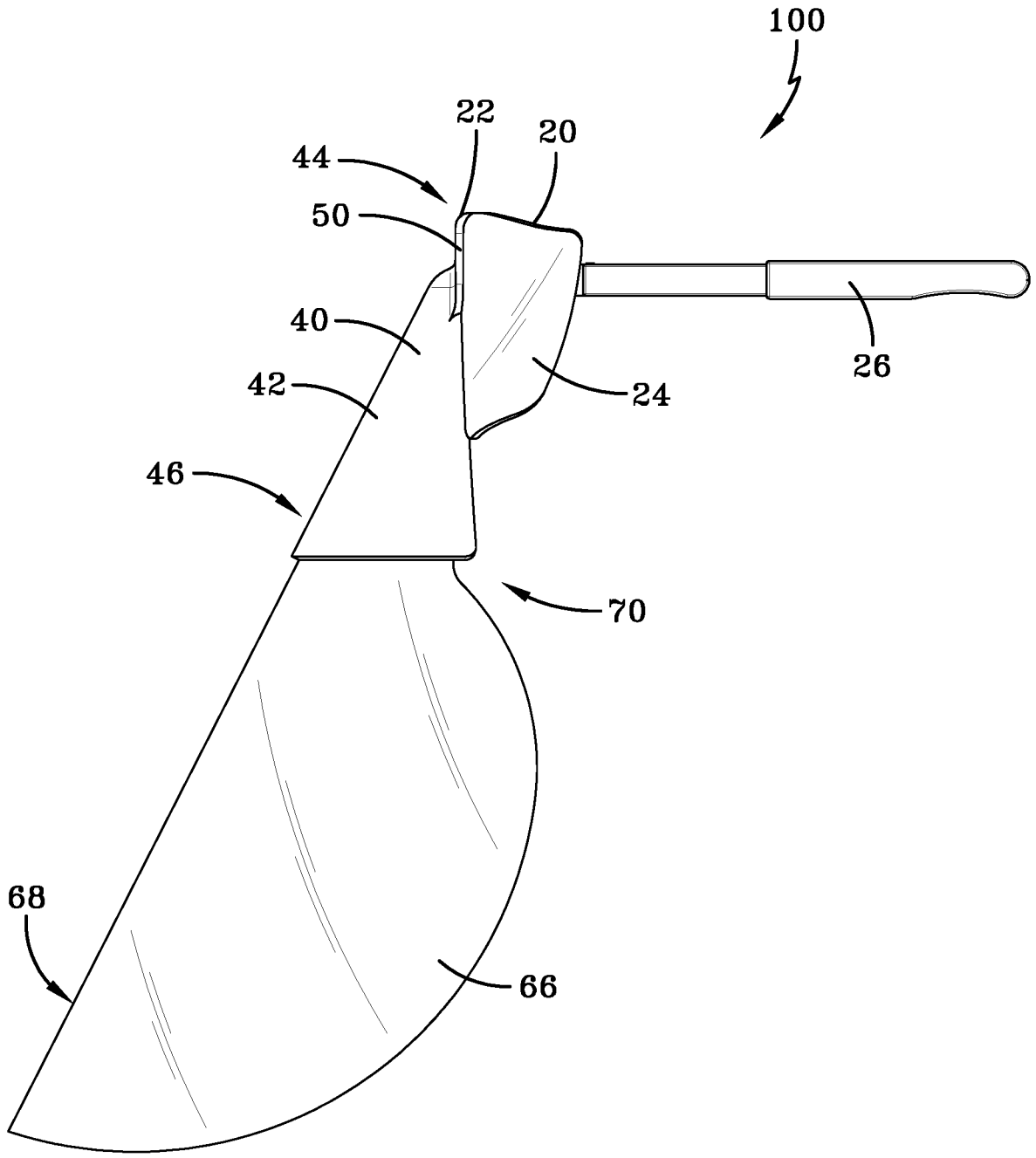
FIG. 27 is a side elevational view of the face mask of FIG. 25.
Figure 28:
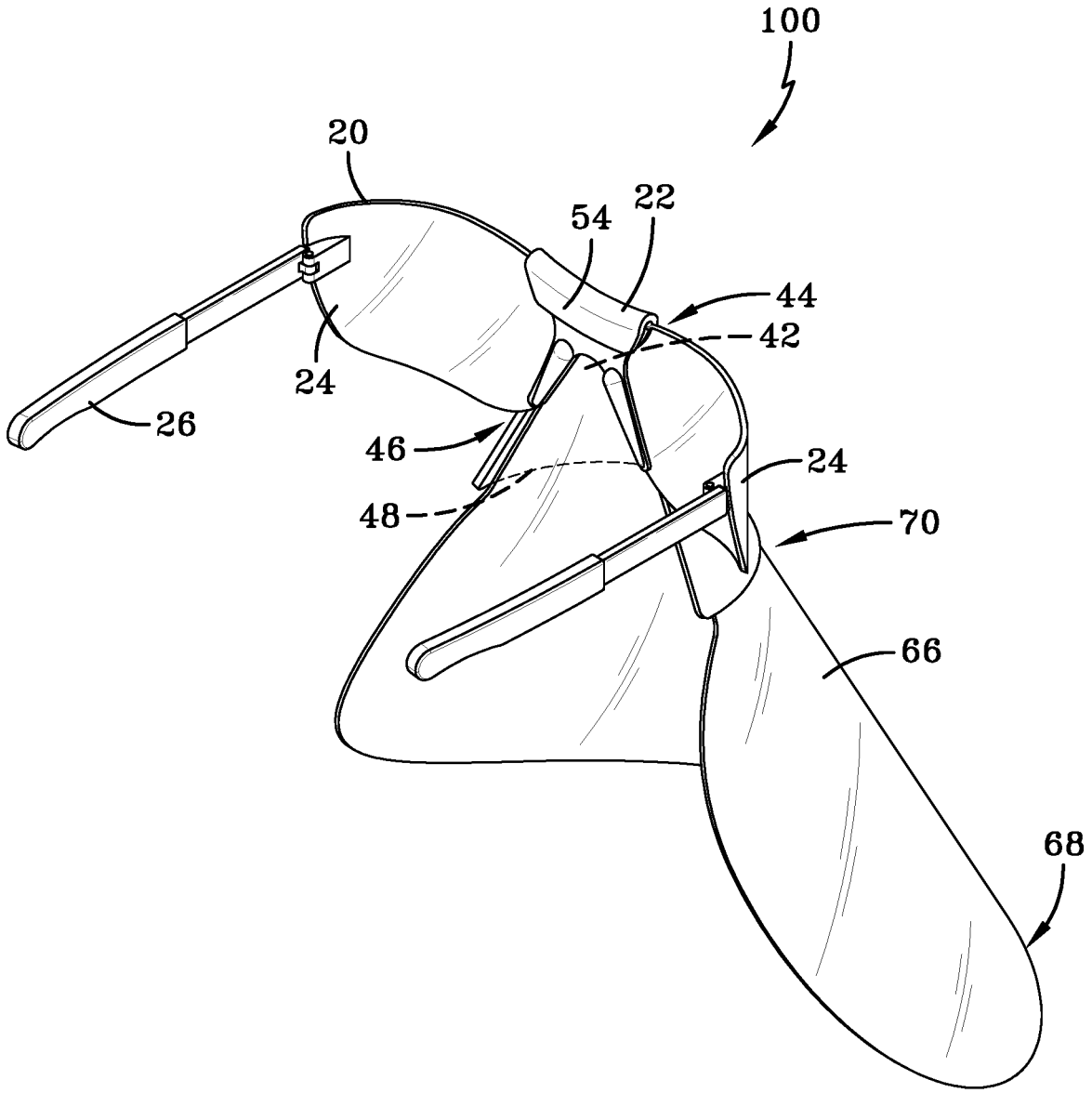
FIG. 28 is a back-perspective view of the face mask of FIG. 25.
Figure 29:
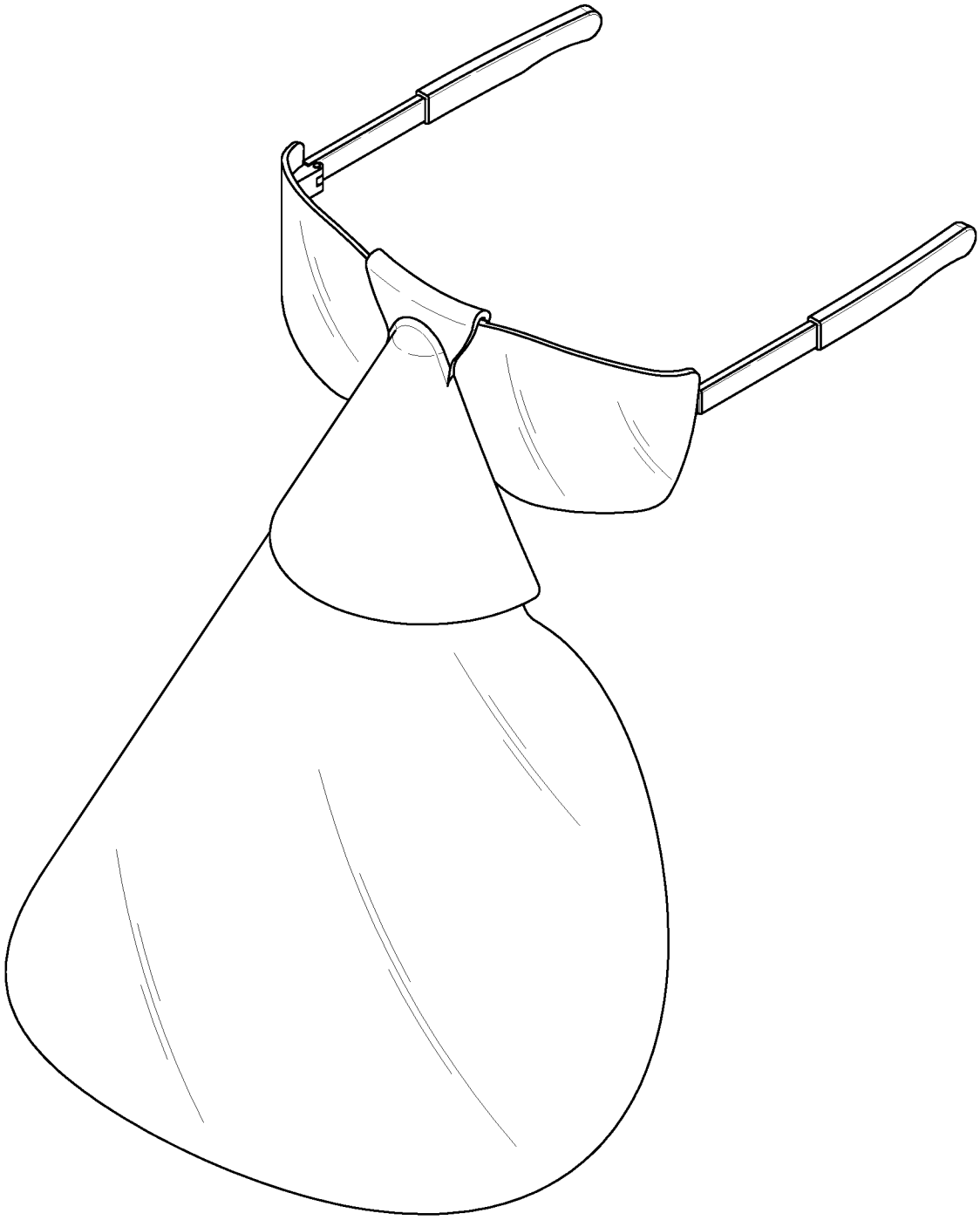
FIG. 29 is a front-perspective view of the face mask of FIG. 25.
Figure 30:
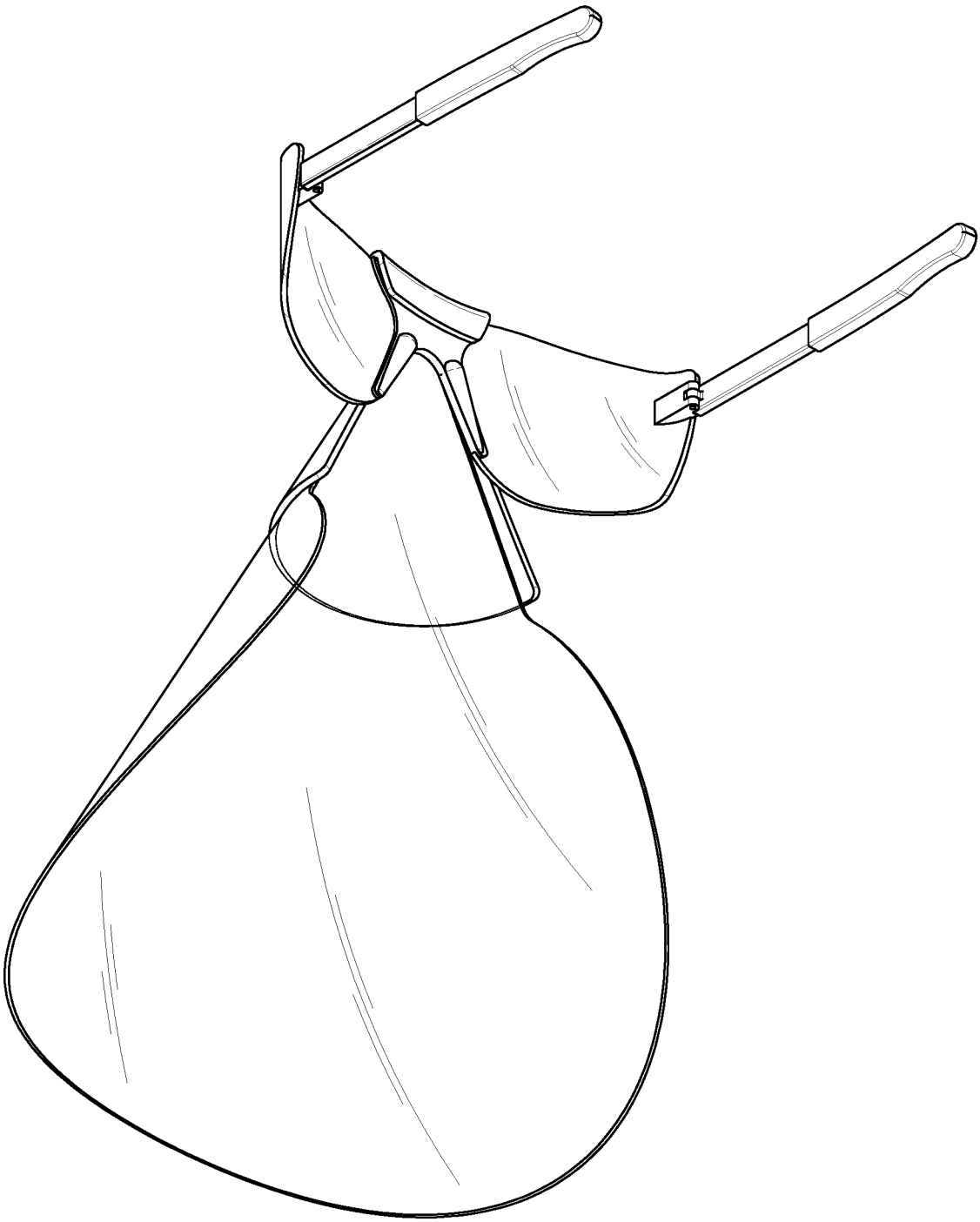
FIG. 30 is a back-perspective view of the face mask of FIG. 29.
Figure 31:
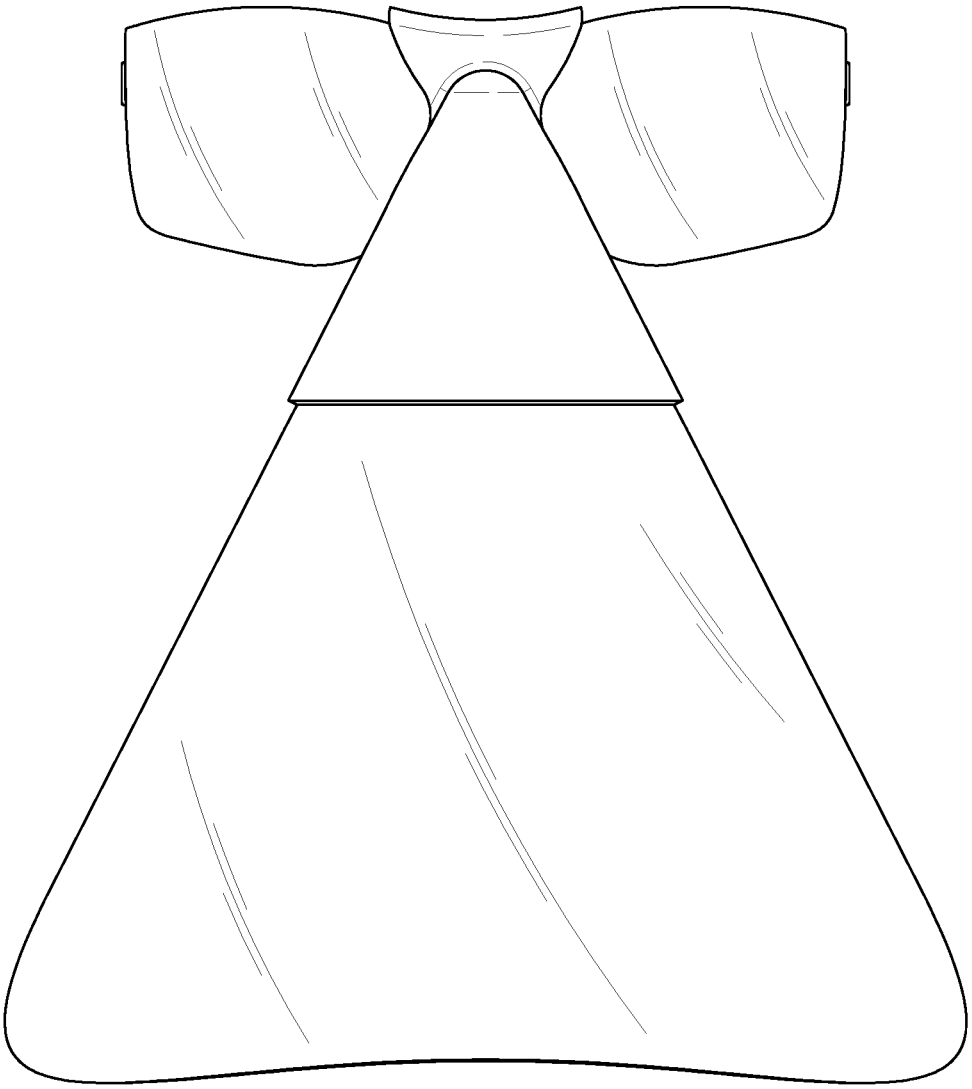
FIG. 31 is a front elevational view of the face mask of FIG. 29.
Figure 32:
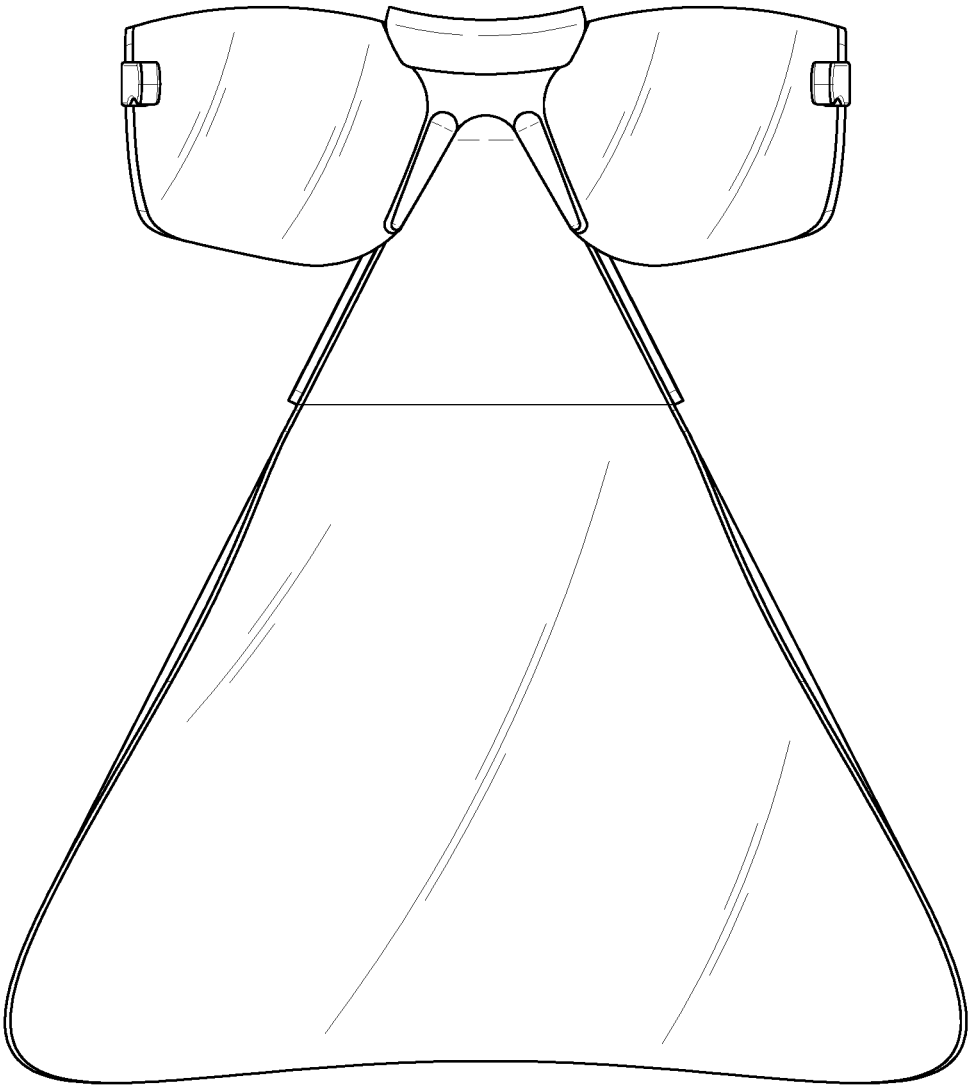
FIG. 32 is a back elevational view of the facemask of FIG. 29.
Figure 33:
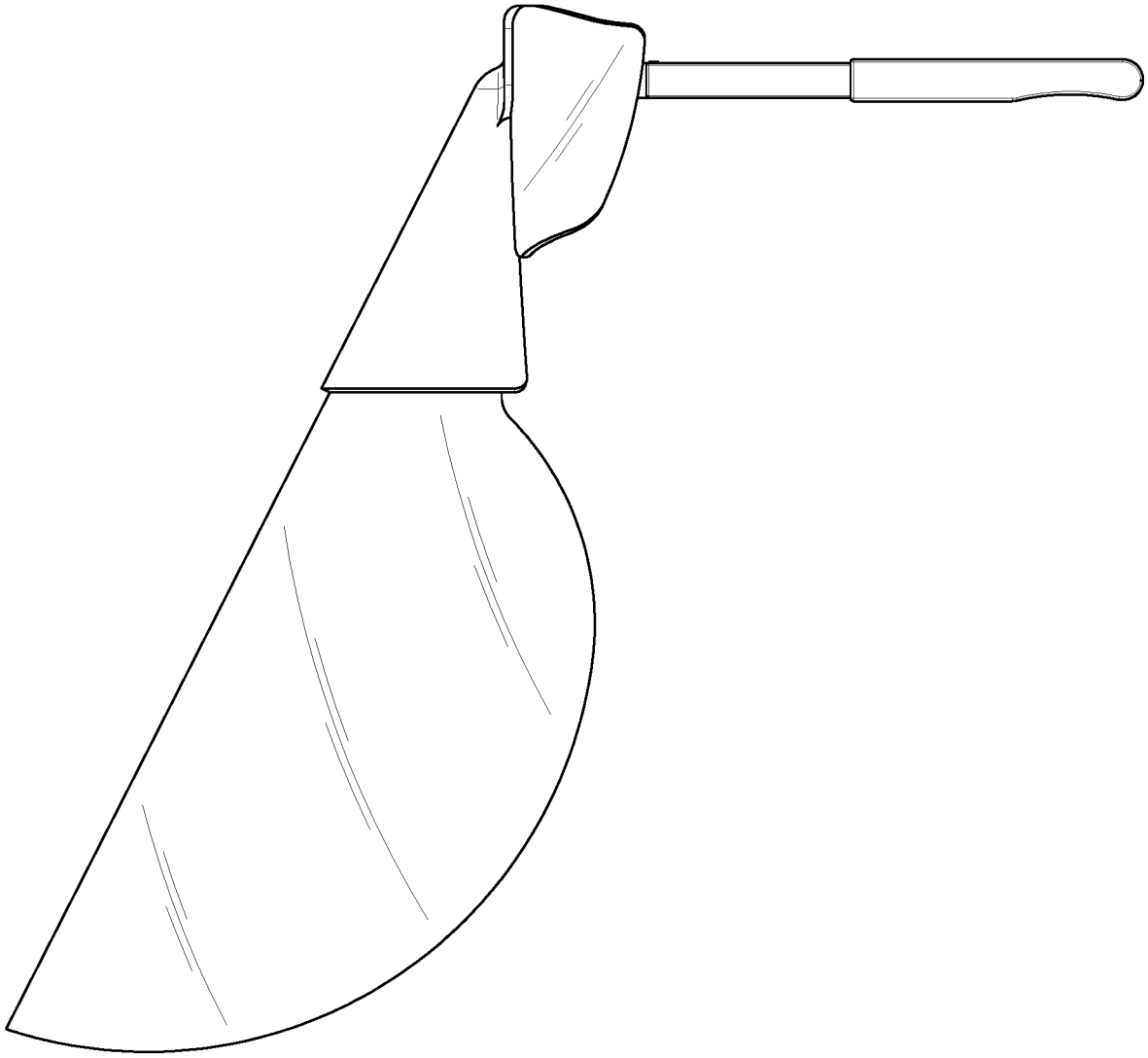
FIG. 33 is a right-side elevational view of the face mask of FIG. 29.
Figure 34:
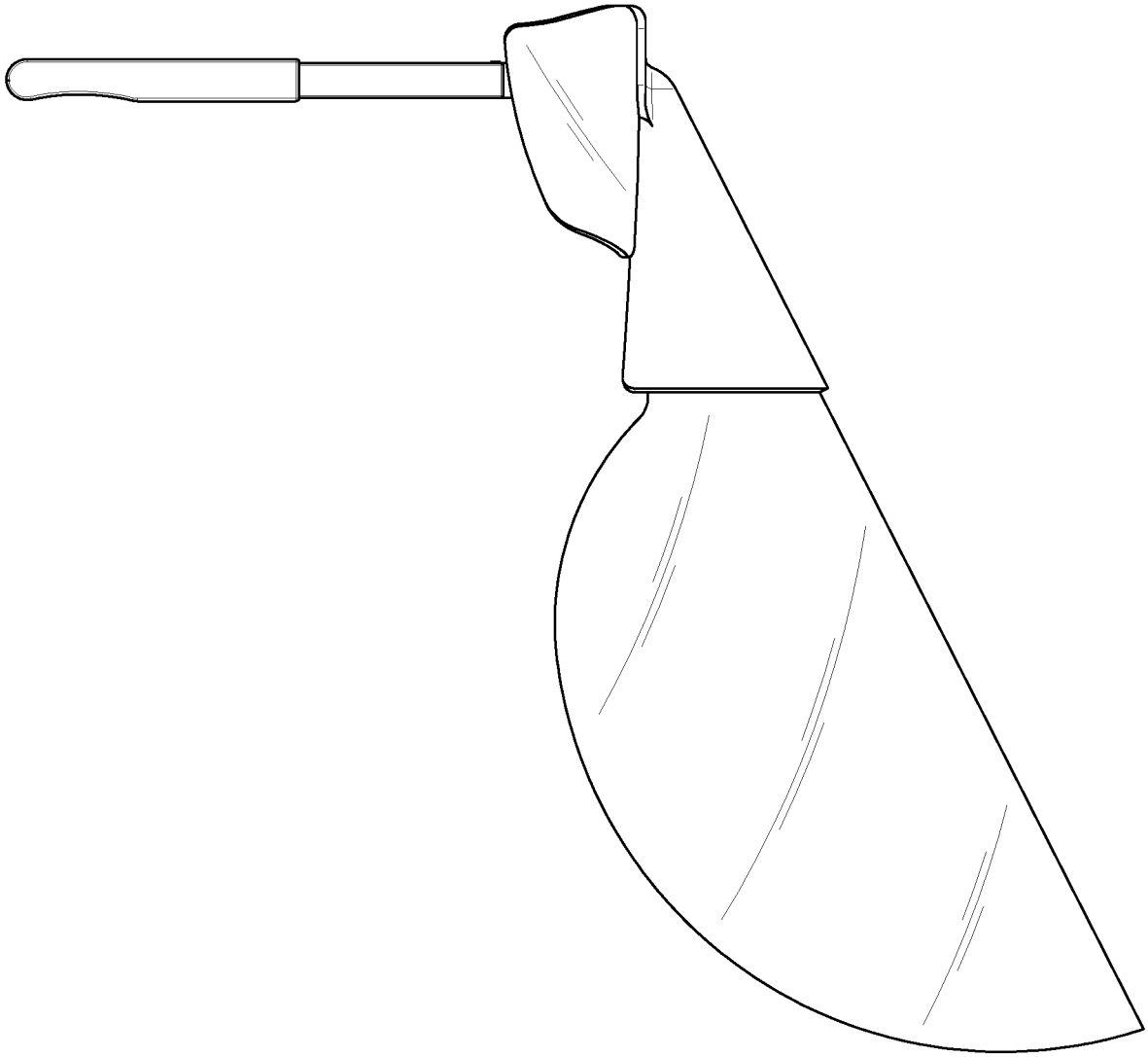
FIG. 34 is a left-side elevational view of the face mask of FIG. 29.
Figure 35:
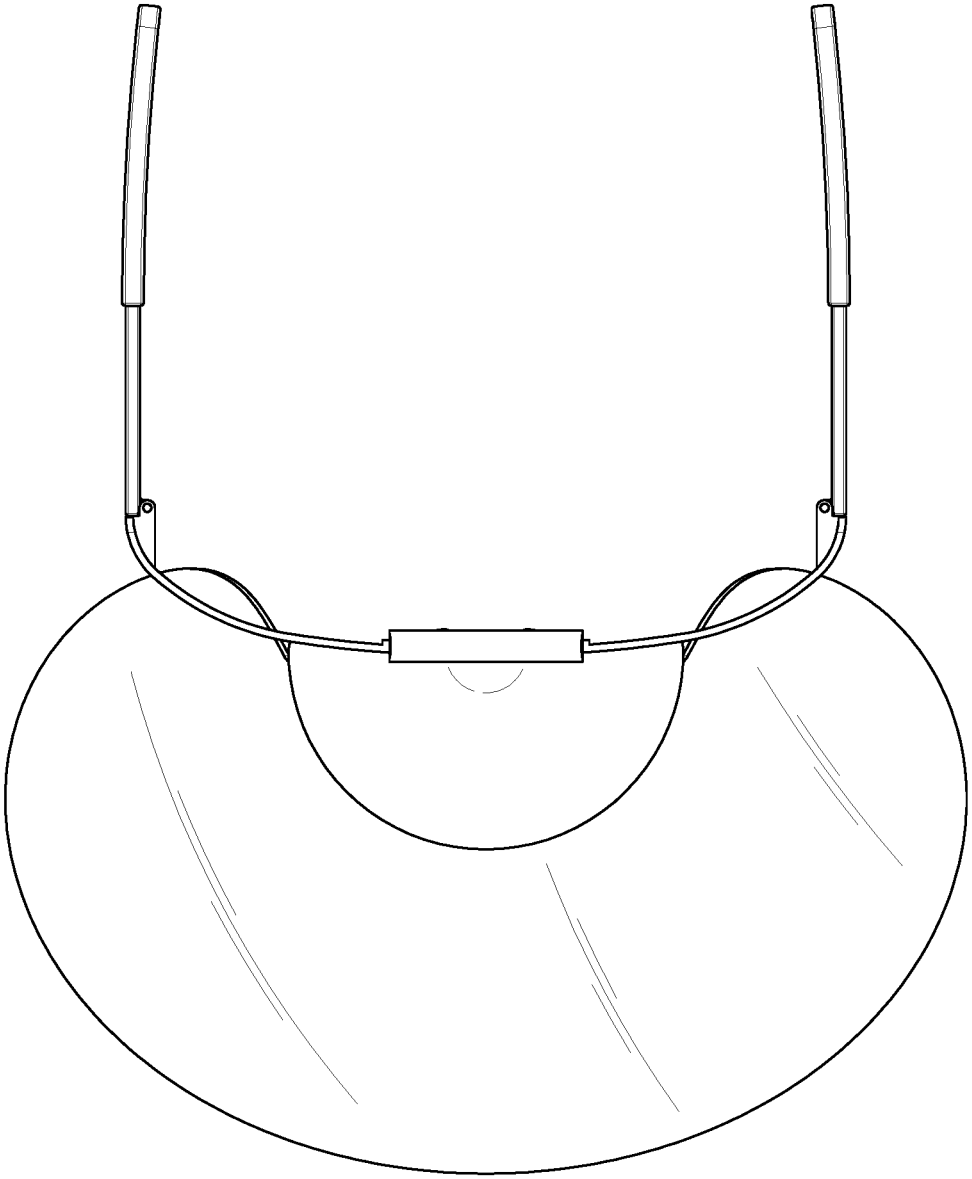
FIG. 35 is a top plan view of the face mask of FIG. 29.
Figure 36:
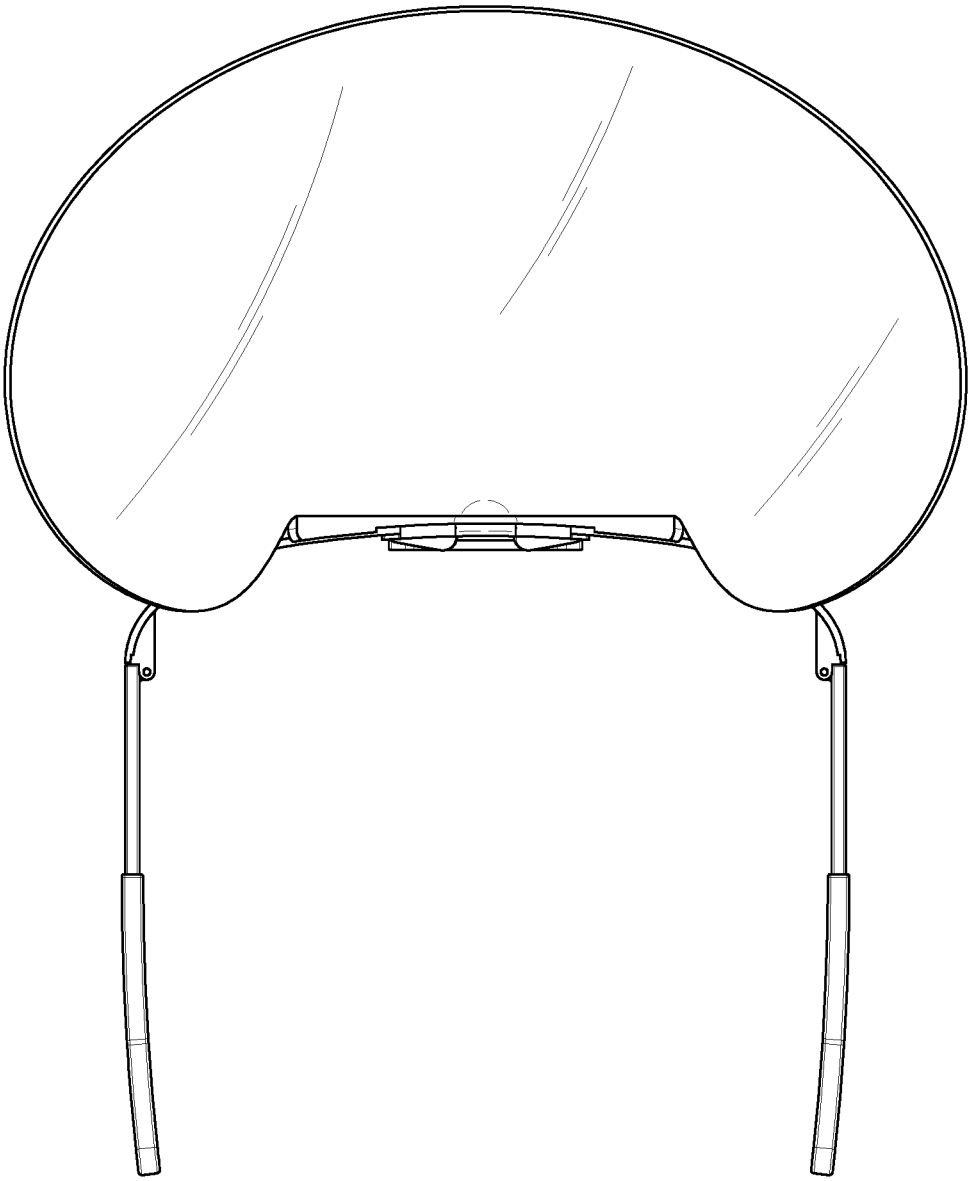
FIG. 36 is a bottom view of the face mask of FIG. 29.
Figure 37:
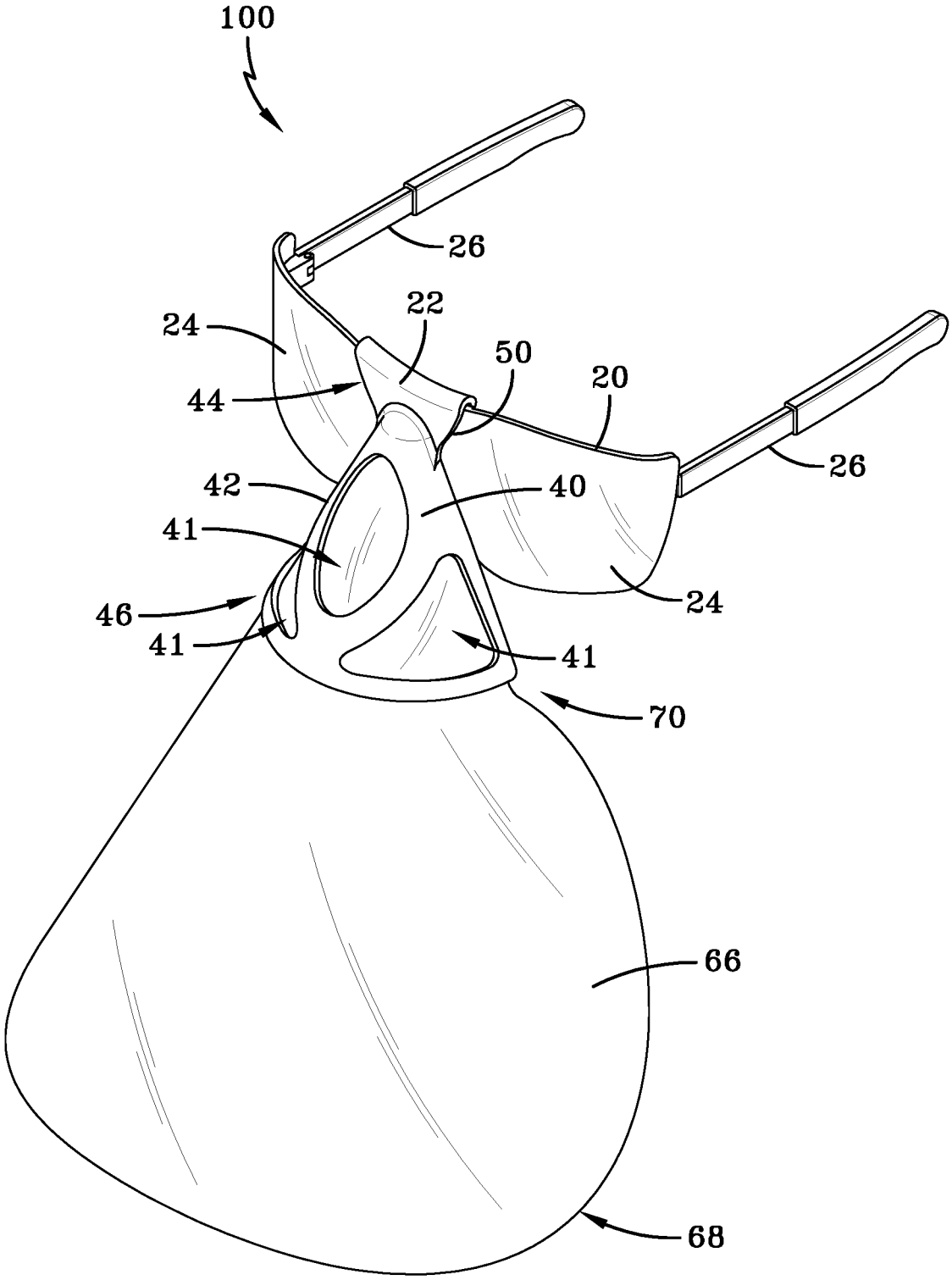
FIG. 37 is a front-perspective view of a third example of the disclosed face mask.
Figure 38:
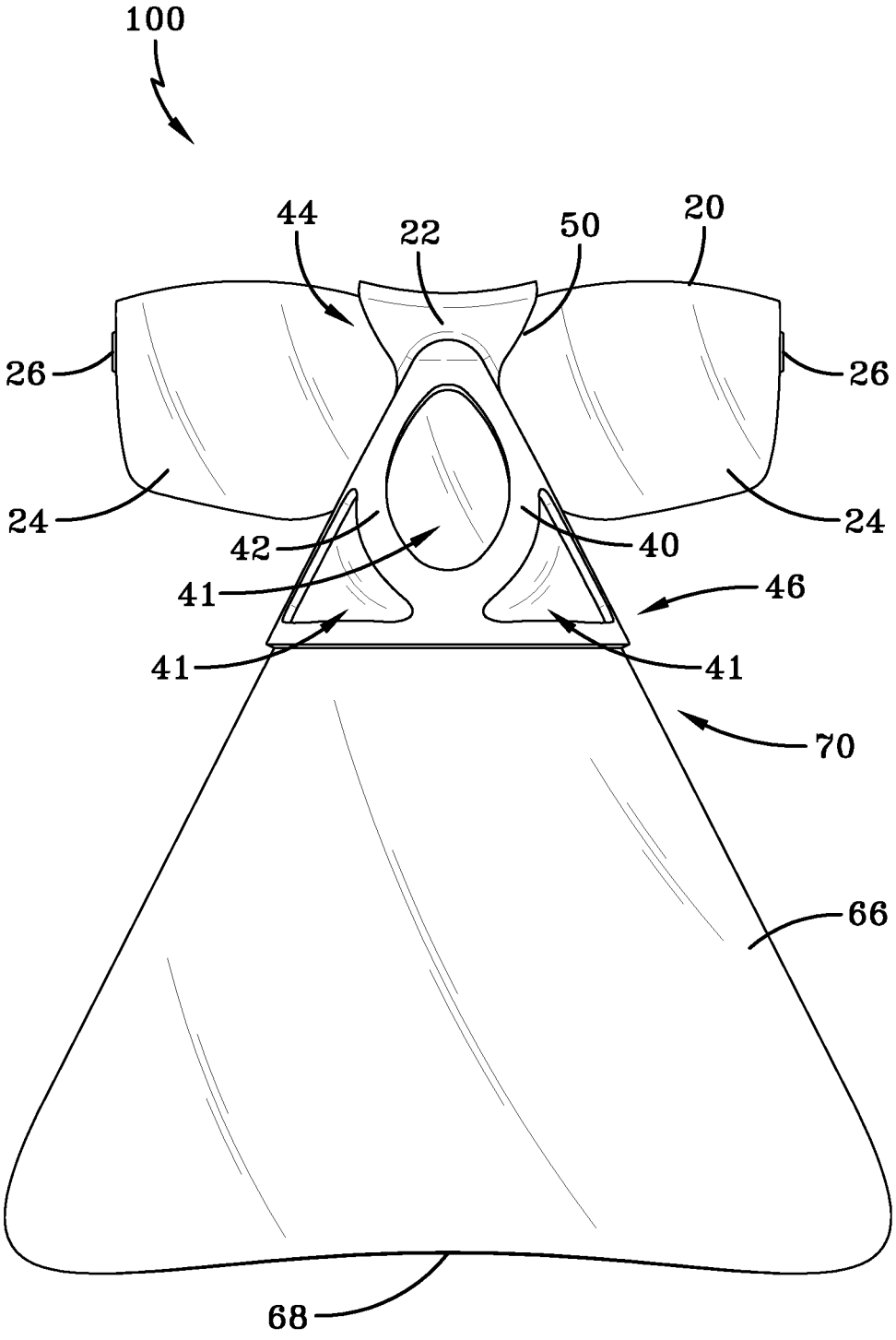
FIG. 38 is a front elevational view of the face mask of FIG. 37.
Figure 39:
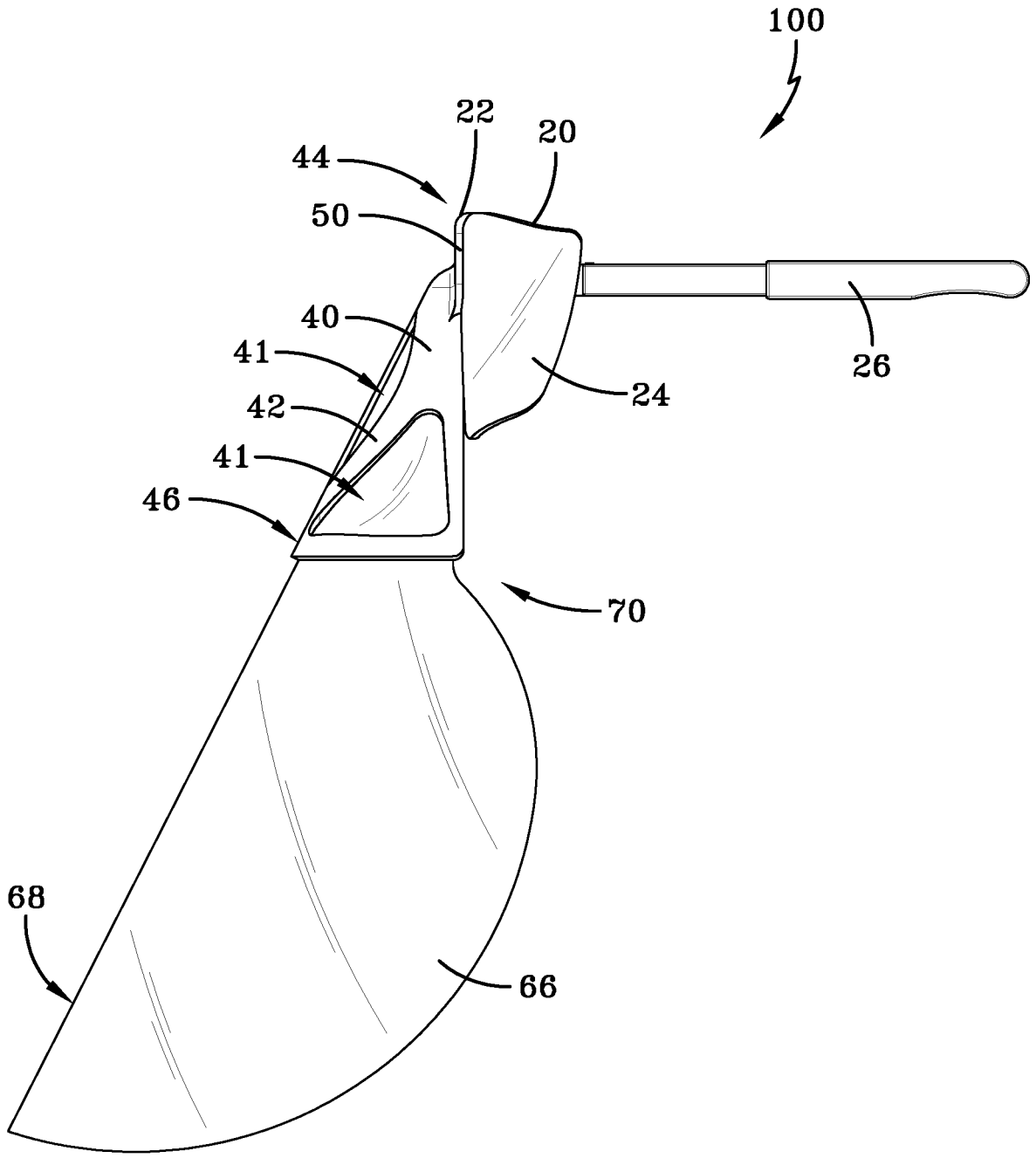
FIG. 39 is a side elevational view of the face mask of FIG. 37.
Figure 40:
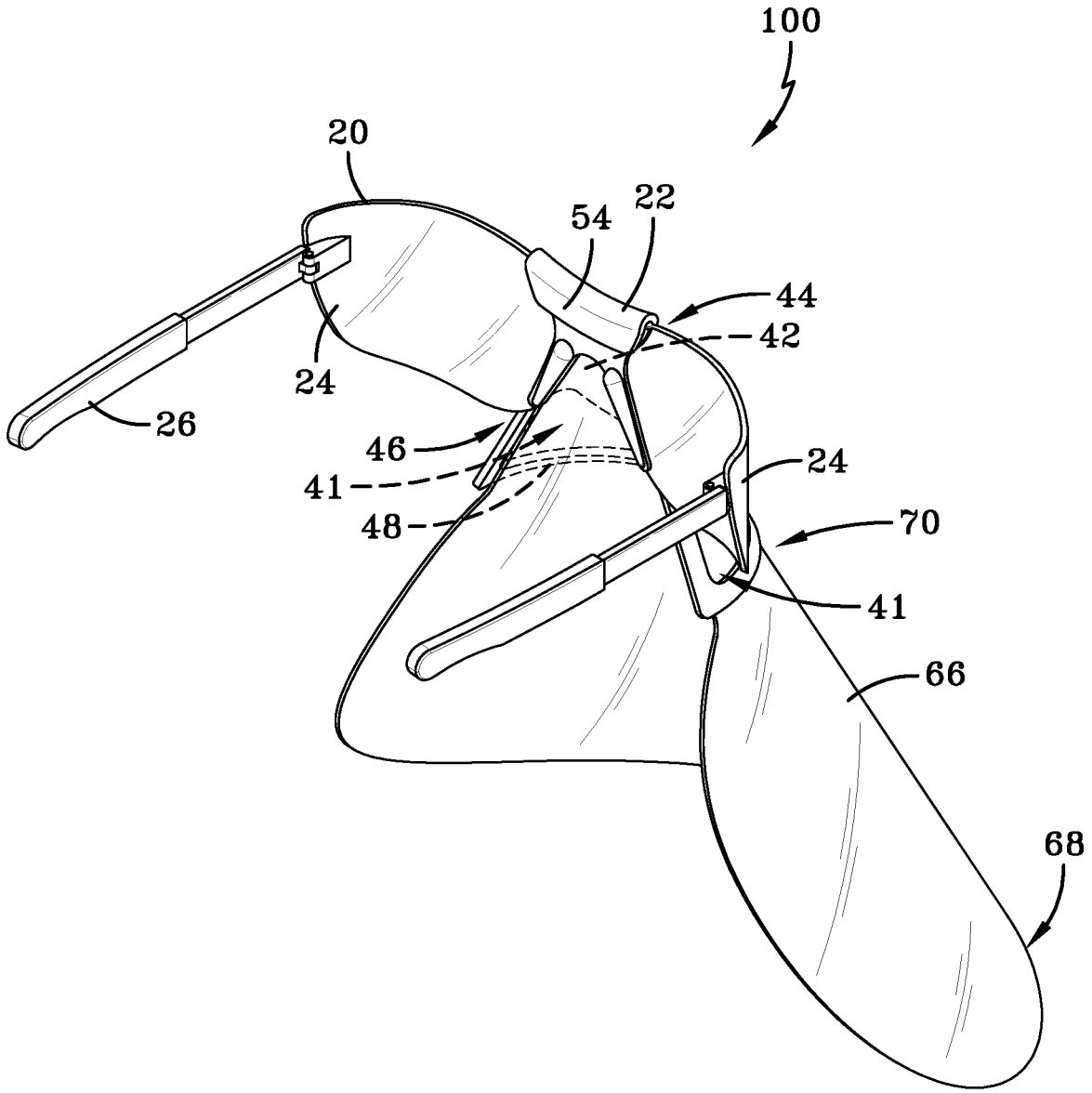
FIG. 40 is a back-perspective view of the face mask of FIG. 37.
Figure 41:
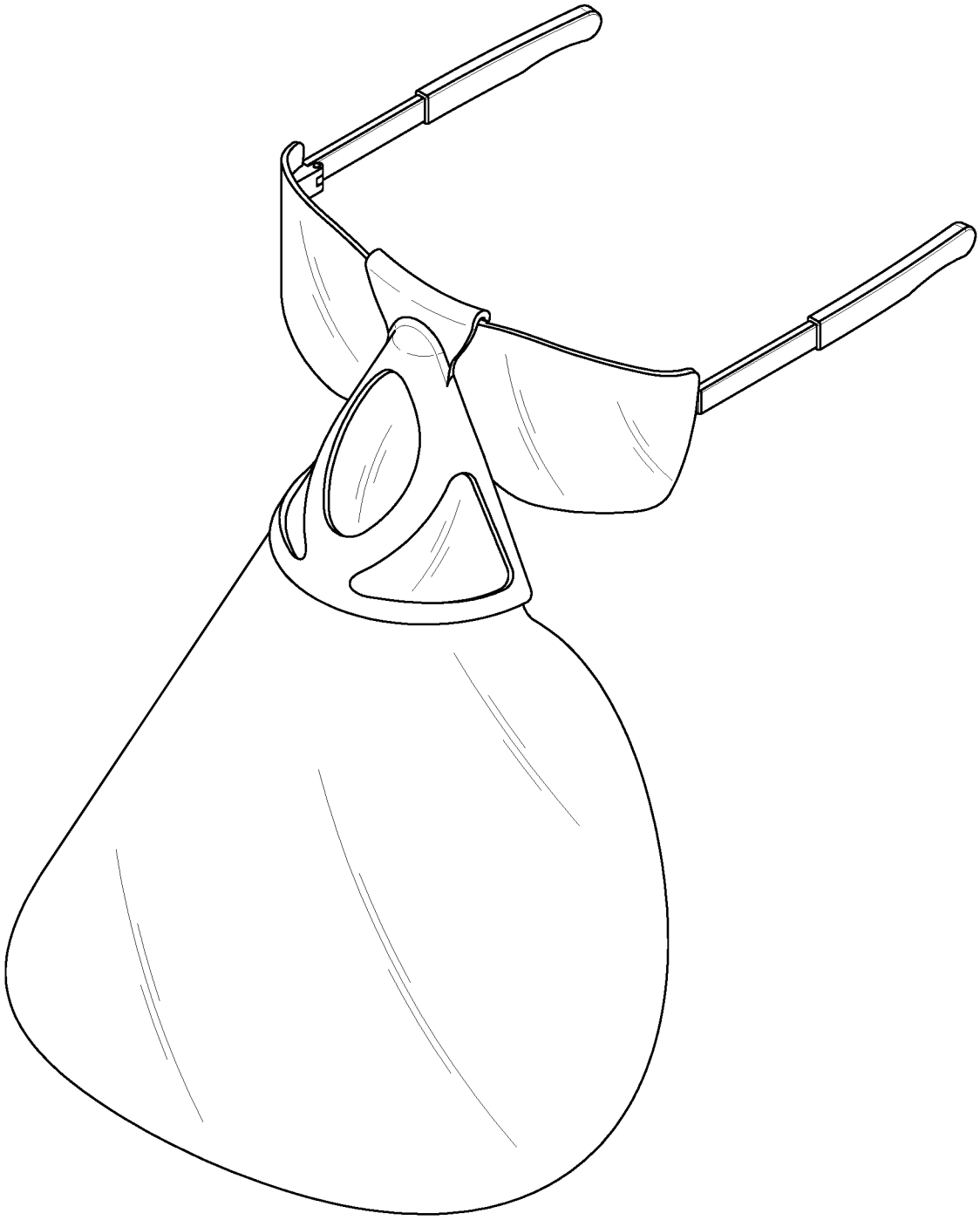
FIG. 41 is a front-perspective view of the face mask of FIG. 37.
Figure 42:
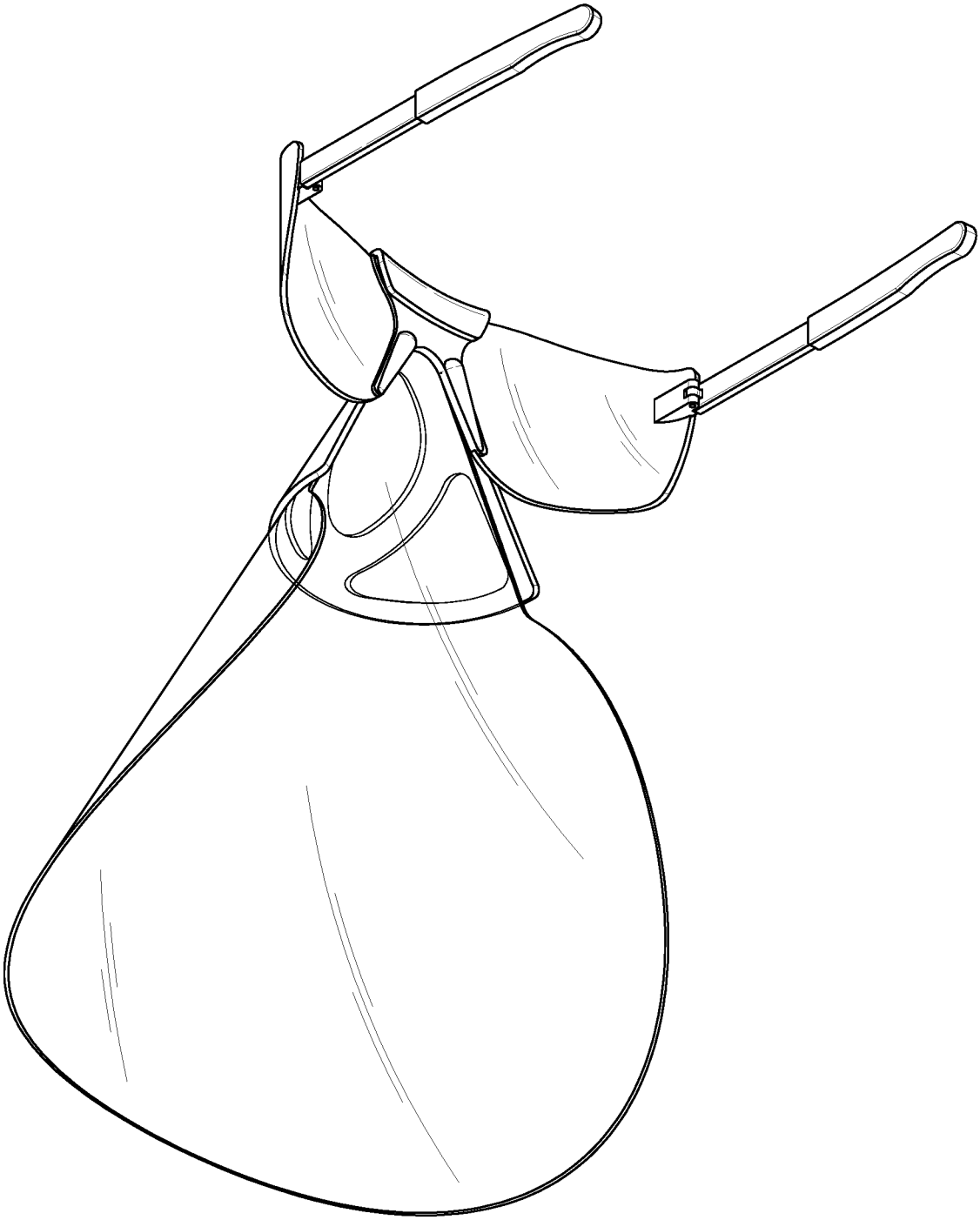
FIG. 42 is a back-perspective view of the face mask of FIG. 41.
Figure 43:
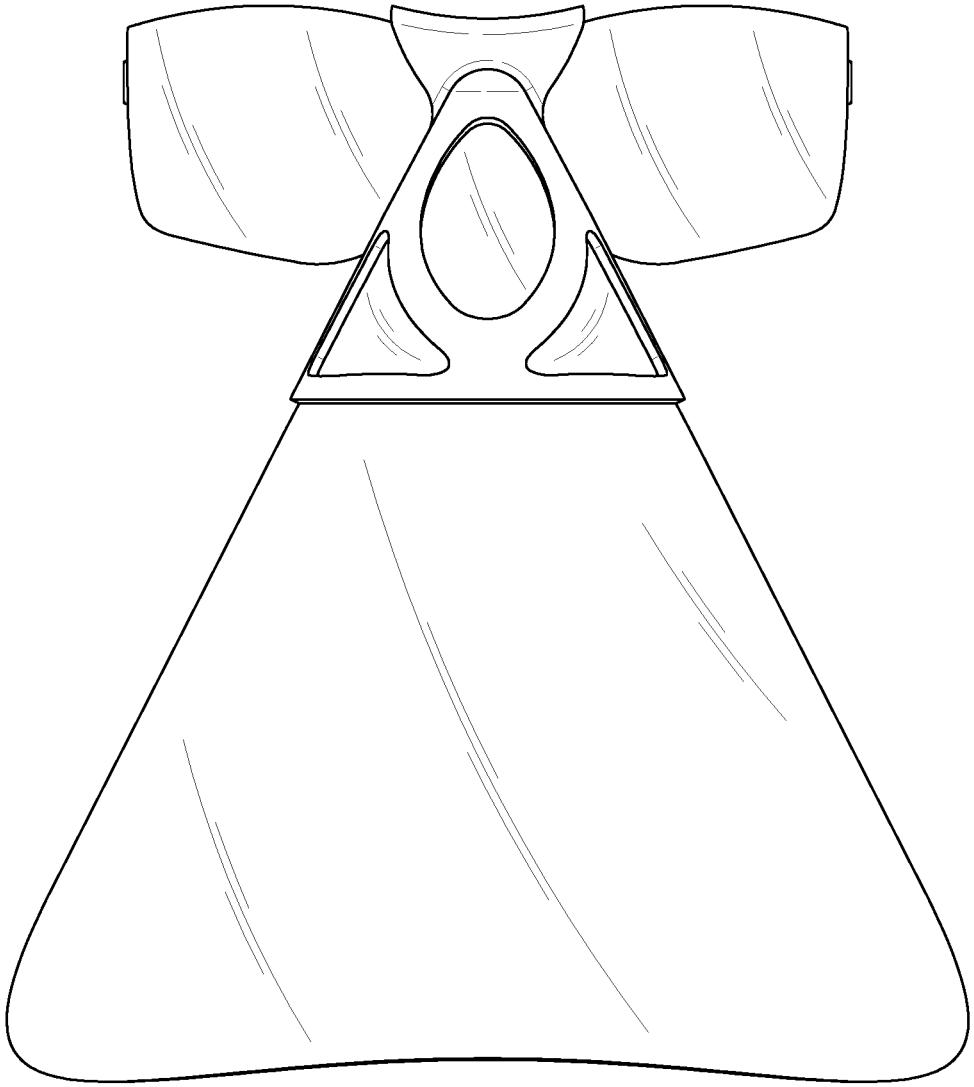
FIG. 43 is a front elevational view of the face mask of FIG. 41.
Figure 44:
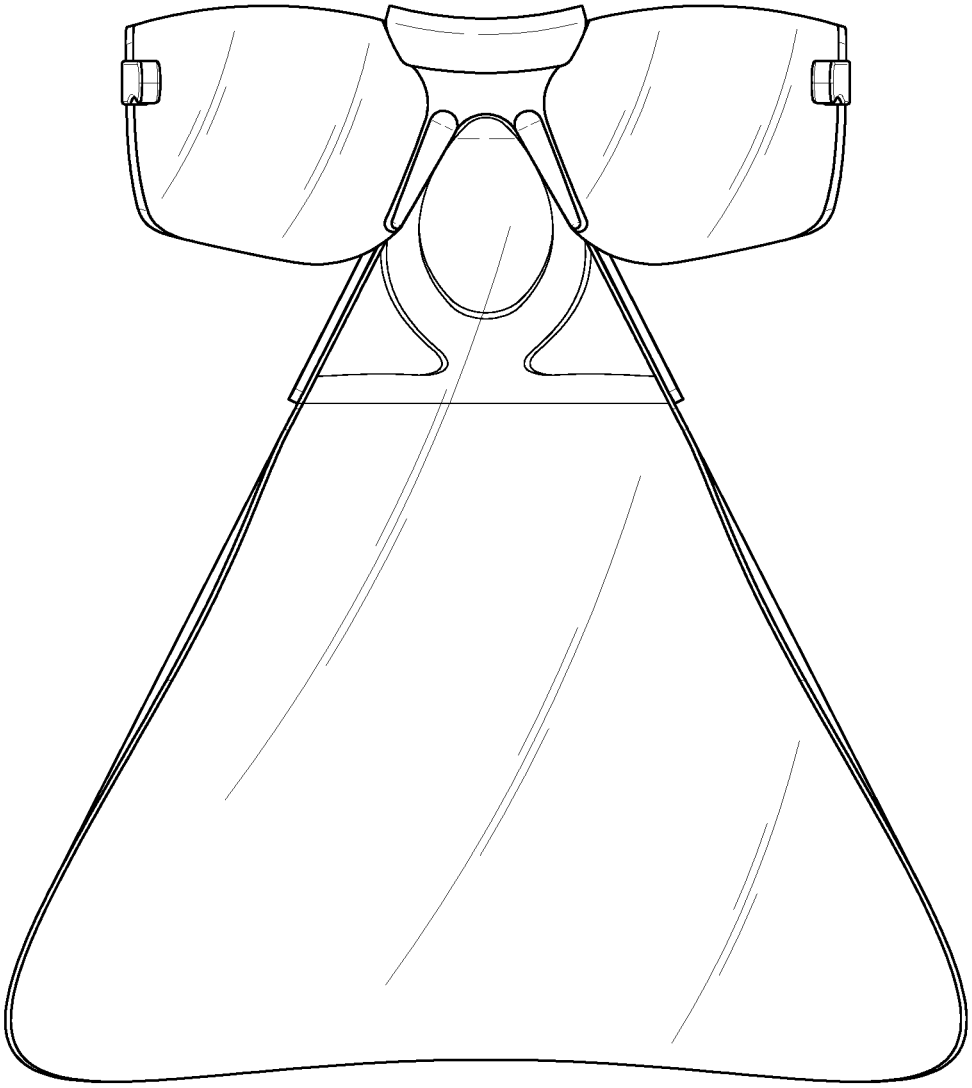
FIG. 44 is a back elevational view of the face mask of FIG. 41.
Figure 45:
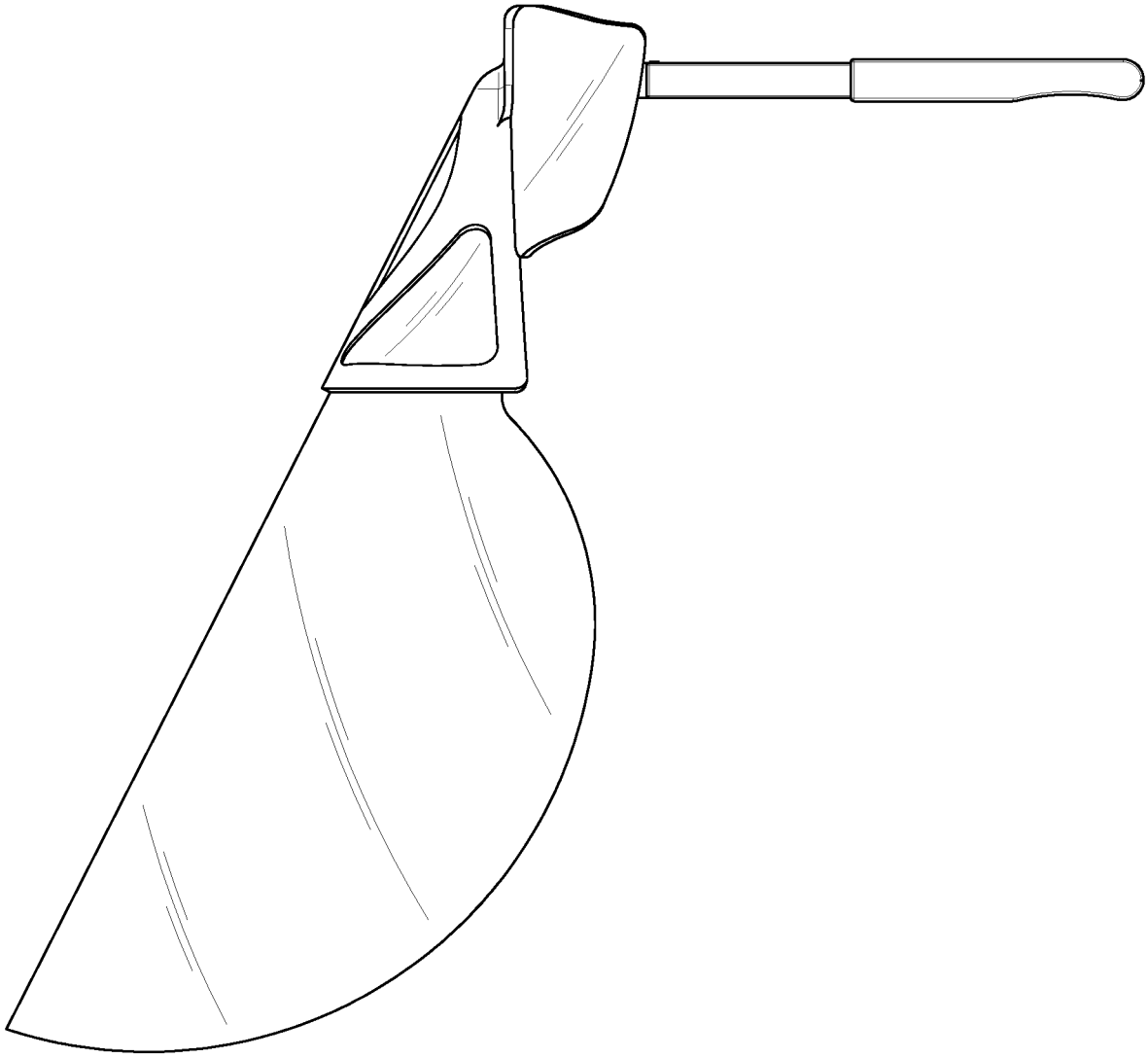
FIG. 45 is a right-side elevational view of the face mask of FIG. 41.
Figure 46:
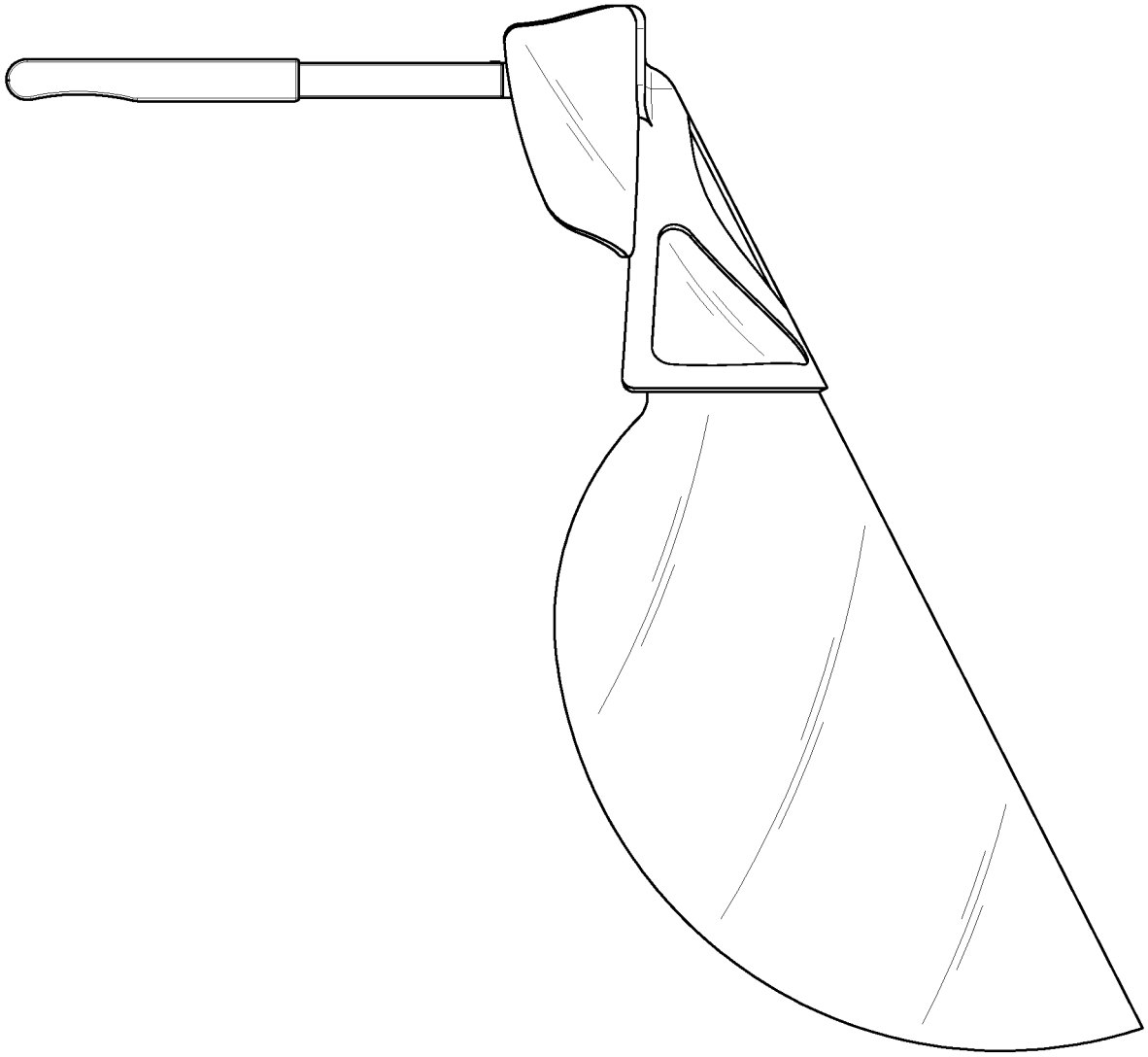
FIG. 46 is a left-side elevational view of the face mask of FIG. 41.
Figure 47:
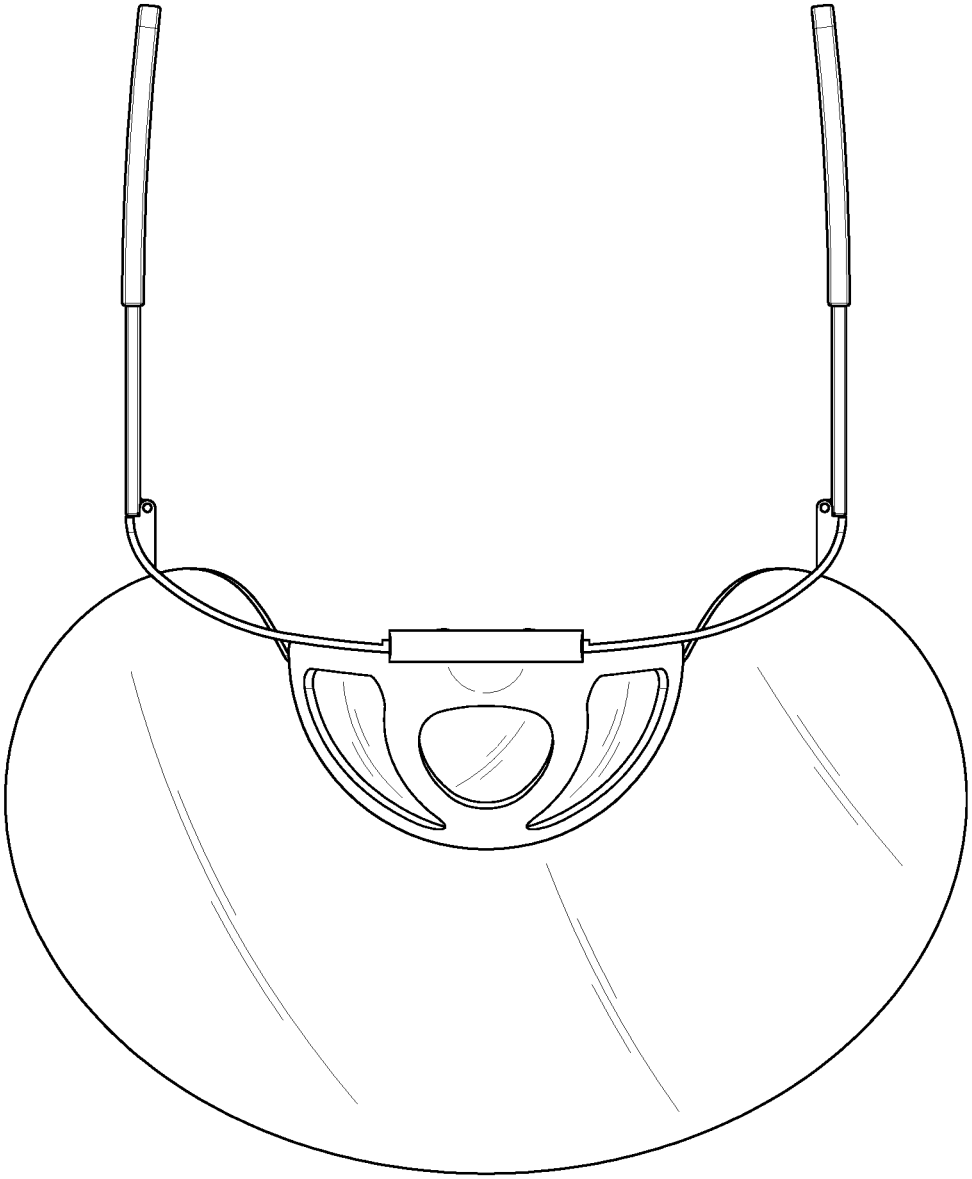
FIG. 47 is a top plan view of the face mask of FIG. 41.
Figure 48:
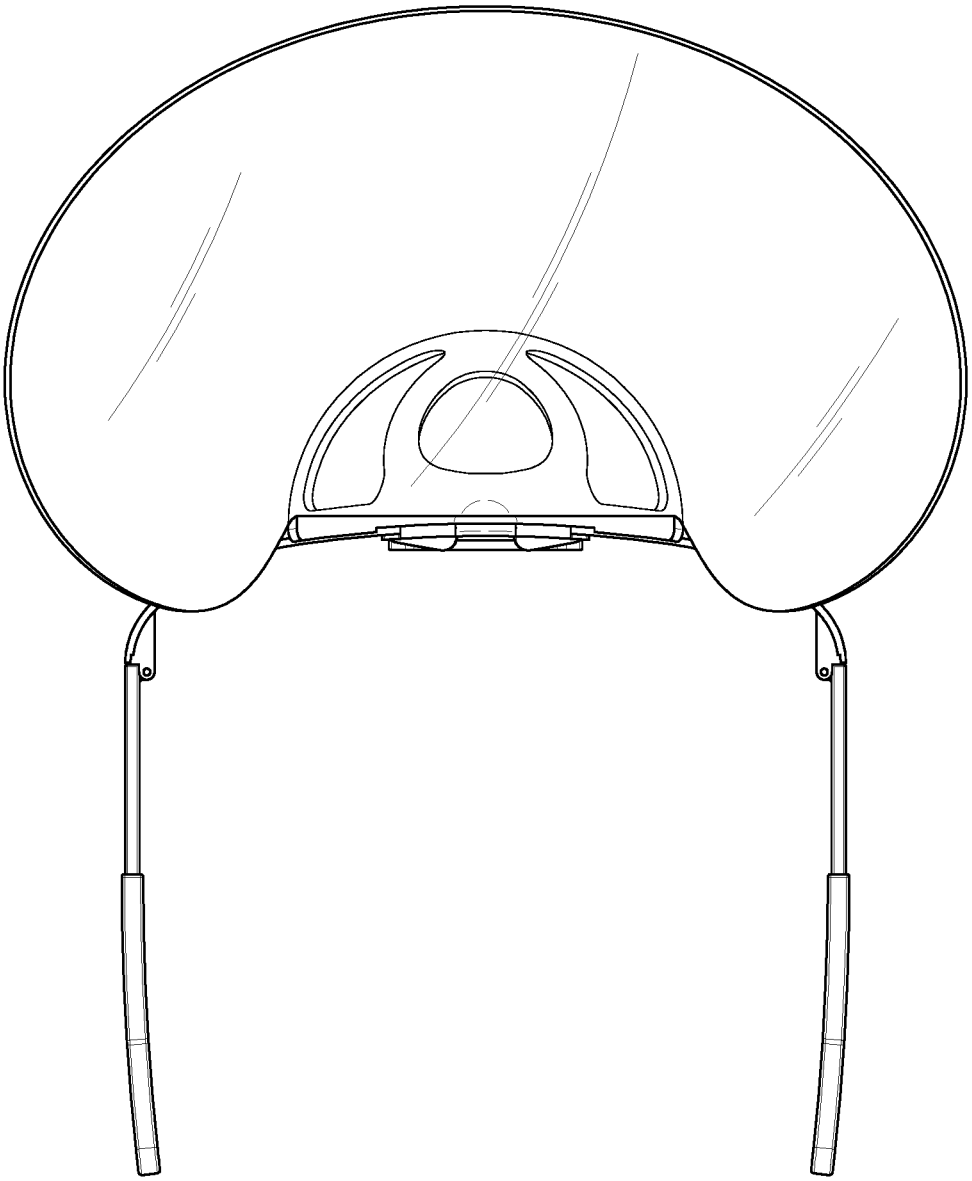
FIG. 48 is a bottom view of the face mask of FIG. 41.

In one or more examples, the attachment feature may be configured to attach to the bridge 22 of the glasses 20. In effect, doing so may secure the nosepiece 40 and the mouth covering 60 to the glasses 20, while also transferring the weight of the nosepiece 40 and mouth covering 60 to the user at the bridge 22 and the temples 26 of the glasses 20. This attachment may be removeable or permanent, and may be achieved in one or more of a variety of different ways. In one example, the attachment feature 52 may include a clip 54 that may receive a portion of the bridge 22 in a press fit, friction fit, snap fit, some combination thereof, or the like arrangement (FIG. 5). In another example, the attachment feature 52 may include an adhesive such that the nosepiece 40 may be adhered to the bridge 22 of the glasses 20. In yet another example, the attachment feature 52 may be fabricated around the bridge 22 so as to completely enclose at least a portion of it (thereby forming a permanent attachment).

In one exemplary embodiment, at least one of the nosepiece 40 (including the body 42 and the attachment portion 50) and the mouth covering may be fabricated (e.g., molded) with the glasses 20 as a single monolithic piece.

The body 42 of the nosepiece 40 may be sized and shaped as appropriate to receive the nose of the user. As shown, the body 42 may define a generally concave, triangular shape that protrudes outward relative to the face of the user. Further, the body 42 may form an arcuate shape that substantially matches the curvature of the user's dorsum nasi. When worn by the user, the body 42 of the nosepiece 40 may be closely received over at least a portion of the dorsum nasi and preferably, may also cover the apex of the nose, as well as both alae (plural of ala).

In one embodiment, the mouth covering 60 may be attached to the bottom 46 of the nosepiece 40, extending downwards such that it covers at least a portion of the user's mouth (e.g., the user's philtum, lips, and mentolabial sulcus). In preferred embodiments, the mouth covering 60 may cover the user's mouth entirely in addition to portions of the user's chin and cheeks. As shown, the mouth covering 60 may include a gas permeable filter portion 62 and an outer edge portion 64 that encompasses the perimeter of the filter portion 62.

The outer edge portion 64 may be connected to the nosepiece 40 by any suitable means. For example, the outer edge portion 64 may be connected to the nosepiece 40 by way of an adhesive. In another example, the outer edge portion 64 may be connected to the nosepiece 40 by way of a mechanical fastener. In yet another example, the outer edge portion 64 may be integral with the nosepiece 40 (i.e., formed as a single monolithic piece).

The filter portion 62 may be sized and shaped to cover at least a majority of the user's mouth, and possibly also a portion of the user's nose (particularly around the apex and the alae). Ideally, the filter portion 62 should be gas permeable, so as to enable the user to breath, while also filtering out undesired particulate matter. Various materials may be used to fabricate the outer edge portion 64 such as, for example, silicone, neoprene, rubber, combinations thereof, and/or the like. The actual filter material of the filter portion 62 may be cloth or filter paper material, or layers thereof, or other filtering materials known to those of ordinary skill in the art of breathing filters.

Referring to FIG. 14-24, in an alternative embodiment, at least part of the filter portion 62 may be replaced with one or more transparent or semitransparent windows 80. These windows 80 may permit others to see the user's mouth while the user is wearing the face mask 100, thereby facilitating ease of communication. As shown, the window 80 may generally encompass the bottom half of the filter portion 62. However, the size, shape, and number of windows is not meant to be limiting, and variations in these design considerations will not result in a departure from the present disclosure. The material composition of these windows may be a polymeric material such as acrylonitrile Butadiene Styrene (ABS), acetal, acrylic, polyvinyl chloride (PVC), high-density polyethylene, low-density polyethylene, polystyrene, nylon, polyethylene terephthalate glycol (PETG), ultra-high-molecular-weight polyethylene (UHMW), combinations thereof, and other materials known for use in transparent face masks, by those of ordinary skill in the art of protective face shields.

It is to be noted that the face mask 100 of the present disclosure may be worn with (i.e., in addition to) conventional face masks, or a conventional face mask may form a part of (i.e., be built into) the face mask 100. Examples of conventional face masks may include basic cloth face masks, surgical face masks, N95 respirators (e.g., the 3MTM Particulate Respirator 07048 available from 3M Corp. of Saint Paul, Minnesota), KN95 respirators, and the like. Depending on the conventional face mask, the user may either put on the conventional face mask first, and then face mask 100 over it; or the user may drape the conventional face mask over face mask 100, most likely covering the mouth covering 60 and portions of the nosepiece 40. FIGS. 14-24 show an N95 respirator 82 received over the mouth covering 60 and most of the nosepiece 40.

Specifically in regards to N95 and KN95 respirators (as well as other types of conventional face masks that may have a shaped, relatively rigid structure), the attachment portion 50 and/or the nosepiece 40 may be raised relative to the face of the user such that a gap is present between the user's face and the nosepiece 40 and/or mouth covering 60. The N95/KN95 respirator may then be attached to face mask 100 (at any point along the attachment portion 50, nosepiece 40, and mouth covering 60) such that it is close to the user's face, but only touches very little of it, if any. This attachment may occur either over or under the nosepiece 40 and/or mouth covering 60, and by way of any suitable method of attachment (e.g., bendable metal clip/strips 84, adhesives, etc.). It is generally contemplated that by raising the attachment portion 50 and/or nosepiece 50 in this way, the user may be afforded greater airflow to and from the user's mouth while still providing some degree of protection from particulate matter. Such a configuration may be preferable to those with claustrophobia, or who are prone to anxiety attacks. Further, as those skilled in the art will appreciate, such a configuration may enable the N95/KN95 respirator to be worn without strings and/or straps.

In embodiments where both windows and conventional face masks are provided, holes or gaps 86 may be provided in the conventional face mask so as to not obstruct the view of the user's mouth. Of course, these holes or gaps 86 may ideally correspond in size, shape, number, and location to the window(s) provided in the mouth covering 60.

Referring to FIGS. 25-36, in an alternative embodiment, the mouth covering 60 may include a mouth shield 66. The mouth shield 66 may be shaped as a half-cone that flares radially outward towards the bottom 68. The upper portion 70 of the mouth shield 66 may be attached to the body 42 of the nosepiece 40. As in the example shown, this upper portion 70 may be attached to the interior surface 48 (e.g., by way of an adhesive) of the nosepiece 40 (i.e., between the nosepiece 40 and the nose of the user). When worn by the user, the mouth shield 66 may cover at least a majority of the user's mouth. The material composition of the mouth shield 66 may be a polymeric material such as acrylonitrile Butadiene Styrene (ABS), acetal, acrylic, polyvinyl chloride (PVC), high-density polyethylene, low-density polyethylene, polystyrene, nylon, polyethylene terephthalate glycol (PETG), ultra-high-molecular-weight polyethylene (UHMW), combinations thereof, and/or the like. Further, this mouth shield 66 may also be transparent, or semitransparent. However, transparency need not be a limiting feature.

In one or more examples, mouth shields 66 having different shapes, such as hemispherical, polygonal, and/or planar shapes, may also be utilized without departing from the scope of the present disclosure. Further, in exemplary embodiments, the mouth shield 66 may be fabricated with the nosepiece 40 and the glasses 20 as a single monolithic piece.

Referring to FIG. 37-48, in yet another alternative embodiment, the body 42 of the nosepiece 40 may also be provided with one or more openings 41 extending through said body 42 to improve airflow to and from the nose. As shown, two lower openings and one upper opening may be provided. The lower openings may have a generally triangular shape extending from the alae to the apex of the nose, whereas the upper opening may have a generally ovoid shape vertically disposed across the dorsum. Those skilled in the art will appreciate that the nosepiece 40 may cover a substantial majority of the user's nose, if not all of it, and thus may make it more difficult for the user to breathe. These openings 41 may rectify this problem by providing a channel to and from the user's nostrils. Of course, different shaped openings 41 may also be employed, and may be employed in different locations along the body 42 of the nosepiece 40. Further, either more or less openings 41 may be provided, also without departing from the scope of the present disclosure.

Figure 49:
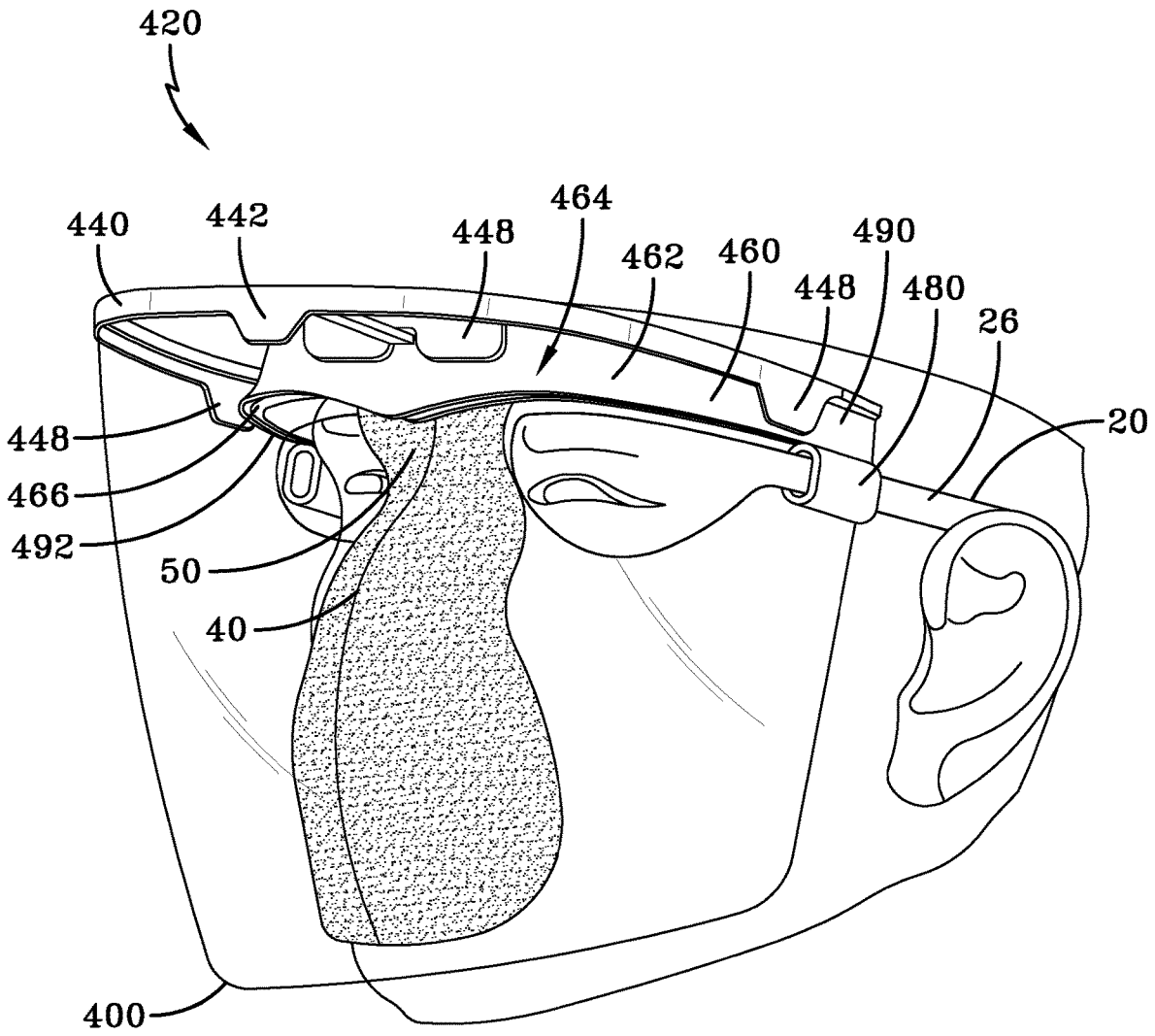
FIG. 49 is a side perspective view of an alternative embodiment of the face mask of FIG. 1 having an additional face shield.

Referring to FIG. 49, in alternative embodiments, any of the face masks 100 of FIGS. 1-13, FIGS. 14-24, FIGS. 25-36 and/or FIGS. 37-48 may further be provided with an additional face shield 400 disposed in front of the nosepiece 40. The additional face shield 400 may be attached to the glasses 20 by way of a mount 420 that includes an outer rim 440, an inner rim 460, and temple attachments 480.

The additional face shield 400 may be fabricated from a transparent or semi-transparent material, such as glass and/or a polymeric material. The additional face shield 400 may be curved or straight, and may be configured to cover at least a portion of the user's face. The size and shape of the additional face shield 400 are design considerations that may be varied as desired.

The inner rim 460 includes a body 462 that is curved to correspond with the curvature of a human forehead. The bottom portion 464 of the body 462 may be shaped to align with the top of a pair of glasses, and may define a channel 466 extending along the length of the body 462 within which the top of the glasses may be received. This configuration enables the inner rim 460 to be received over the user's forehead without uncomfortably abutting against it. In some embodiments, however, the inner rim 460 may be configured to rest against the user's forehead, though such is not required. Further, the attachment portions 50 of the nosepieces show in FIGS. 1-48 may be connected to the inner rim 460. Alternatively, the inner rim 460 and the attachment portions 50 may be connected to the glasses 20 separately.

The outer rim 440 includes a body 442 that extends past the inner rim 460 in an arcuate shape, though other shapes are also contemplated. This configuration enables the additional face shield 400, once attached, to prevent transmission and receipt of particulate matter, while also preventing the user's face from fogging or inadvertently contacting the additional face shield. Like with the inner rim 460, the body 442 of the outer rim 440 may be curved as appropriate to correspond with the shape of the additional face shield 400 (more specifically, an edge 402 of the additional face shield 400). The outer rim 440 may also include one or more clips 448 spaced along the length of the outer rim 440 to facilitate attachment of the additional face shield 400.

The temple attachment 480 may be configured to receive, or otherwise attach to, the temple 26 of the glasses 20. As shown, the temple attachment 480 may be fabricated as a hollow cylinder, though other shapes are also contemplated. In practice, the temples 26 of the glasses 20 may first be inserted through the temple attachments 480, and then raised into the channel 466 of the inner rim 460.

The inner rim 460, the outer rim 440, and the temple attachments 480 may be connected at end portions 490, 492. These end portions 490, 492 may be disposed proximate the temple of the user. In one example, the inner rim 460, the outer rim 440, and the temple attachments 480 may be fabricated as a single monolithic piece, converging at the end portions 490, 492. In another example, inner rim 460, the outer rim 440, and the temple attachments 480 may be fabricated as separate pieces and affixed together at the end portions 490, 492. Various other configurations may also be utilized without departing from the scope of the present disclosure.

Alternatively, in one or more examples, the additional face shield 400 and the mount 420 (including any components thereof), in part or in its entirety, may be fabricated with the glasses 20 as a single monolithic piece.

The various components of the mount may be fabricated out of any suitable material, such as acrylonitrile butadiene styrene (ABS), thermoplastic elastomers (TPE), polylactic acid (PLA), high impact polystyrene (HIPS), polyethylene terephthalate glycol (PET), nylon, carbon fiber, acrylonitrile styrene acrylate (ASA), polycarbonate, polypropylene, metal, wood, poly(vinyl alcohol) (PVA), combinations thereof, and/or the like.

Figure 50:
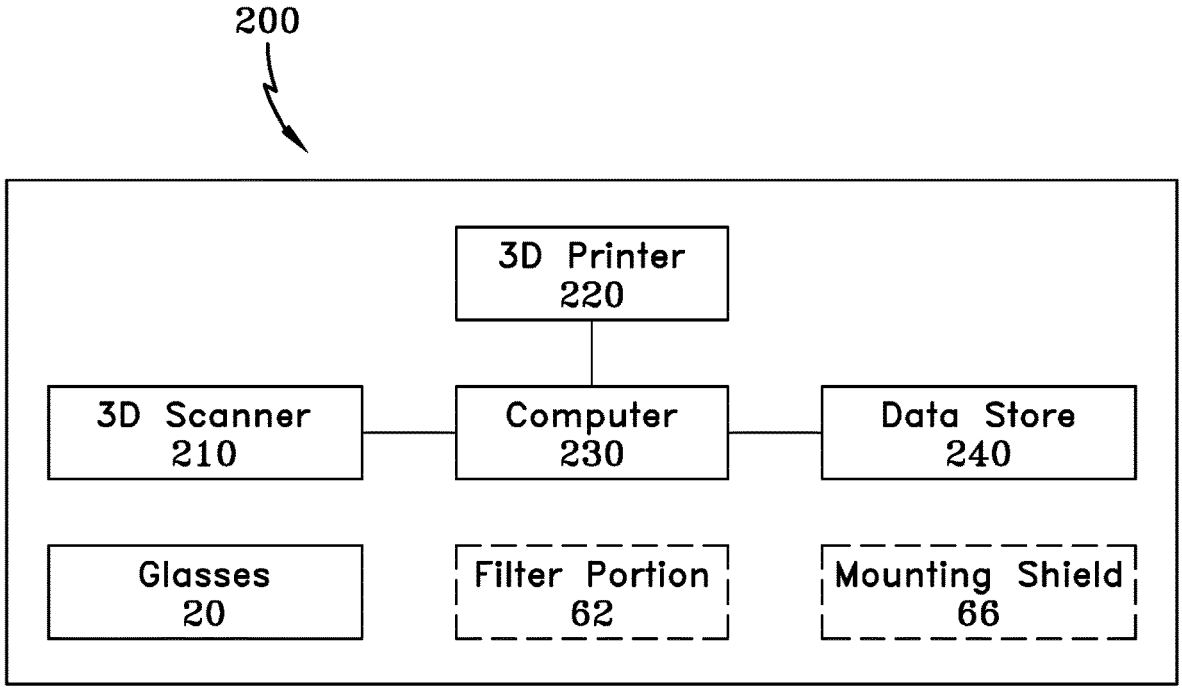
FIG. 50 is a schematic illustration of an example of a system for manufacturing face masks.

Referring to FIG. 50, the present disclosure provides an example of a system 200 for manufacturing that may be used to manufacture the any of the face masks 100 of FIGS. 1-48. The system may include, among other things, a 3D scanner 210, a 3D printer 220, a computer 230, a data store 240, and glasses 20. The 3D scanner 210, the 3D printer 220, the computer 230, and the data store 240 may all be in electronic communication with one another. Further, such a system 200 may also include filter portions 62 and/or mouth shields 66.

Figure 51:
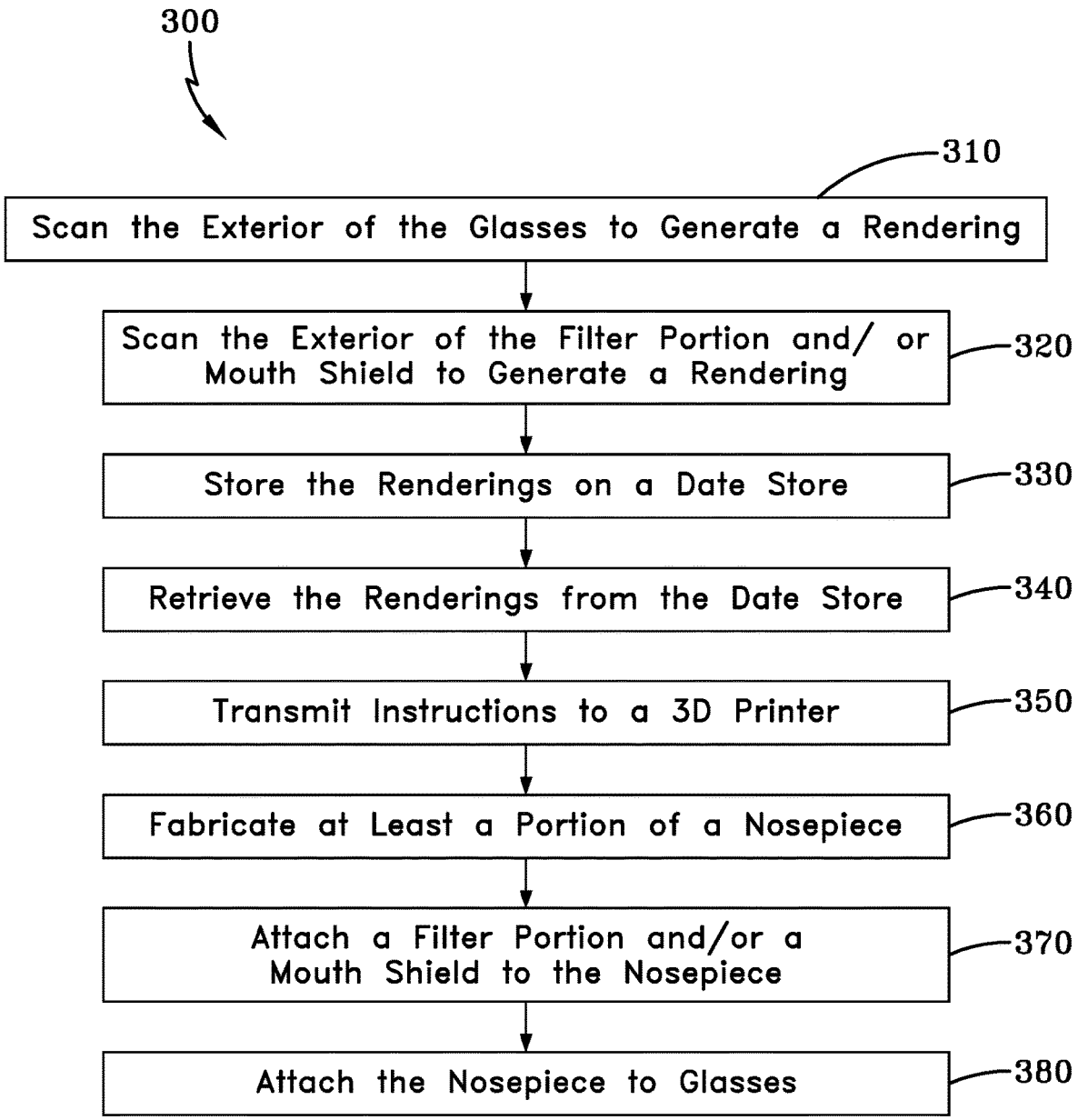
FIG. 51 is a flow diagram of an example method for manufacturing face masks.

Referring to FIG. 51, as an example method 300, the 3D scanner 210 may be used to scan the exterior of the glasses 20 to generate a rendering of the glasses 20 (block 310). The 3D scanner 210 may also be used to scan the exterior of the filter portions 62 and/or mouth shields 66 to generate renderings thereof (block 320). These renderings may be stored on the data store 240 (block 330), until retrieved by the computer 230 as needed (block 340). From there, the computer 230 may be used to transmit instructions to the 3D printer 220 (block 350) to fabricate at least a portion of an appropriately shaped nosepiece 40 (block 360) capable of attachment to the glasses 20 and the filter portions 62 and/or mouth shields 66. The filter portions 62 and/or mouth shields 66 may then be attached to the nosepiece (block 370), which may then be attached to the glasses (block 380).

The 3D printer 100 may be any type of 3D printer including, but not limited to, stereolithography (SLA), digital light processing (DLP), fused deposition modeling (FDM), selective laser sintering (SLS), selective laser melting (SLM), electronic beam melting (EBM), laminated object manufacturing (LOM), binder jetting (BJ), material jetting (MJ), some combination thereof, or the like.

Any embodiment of the present invention may include any of the features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

Certain operations described herein may be performed by one or more electronic devices. Each electronic device may comprise one or more processors, electronic storage devices, executable software instructions, and the like configured to perform the operations described herein. The electronic devices may be general purpose computers or a specialized computing device. The electronic devices may comprise personal computers, smartphone, tablets, databases, servers, or the like. The electronic connections and transmissions described herein may be accomplished by wired or wireless means. The computerized hardware, software, components, systems, steps, methods, and/or processes described herein may serve to improve the speed and automation of the computerized hardware, software, systems, steps, methods, and/or processes described herein.

Although various examples of the disclosed face mask 100 have been shown and described, modifications may occur to those skilled in the art upon reading the specification. The present application includes such modifications and is limited only by the scope of the claims.

What is claimed is:

1. A face mask comprising:

glasses configured to be worn by a user, said glasses comprising a bridge;

a nosepiece comprising:

a filter body configured to receive and cover a nose and at least a majority of a mouth of said user when said face mask is worn by the user; and an attachment portion disposed along a top of said filter body and comprising an attachment feature configured to securely attach said nosepiece to said bridge of said glasses; and a face shield connected to said nosepiece and comprising a shield portion, an inner rim configured to rest against the user's forehead when the face mask is worn, an outer rim spaced apart from said inner rim a maximum distance proximate to the bridge, wherein said inner rim and said outer rim intersect at a first temple area of the face shield and a second temple area of the face shield, clips attaching the shield portion to said outer rim, a first attachment device located at said first temple area, and a second attachment device located at said second temple area, wherein said first and second attachment devices are configured to permit removable connection of said face mask shield to said glasses;

wherein said nosepiece is attached to said face shield at said inner rim.

2. The face mask of claim 1 wherein:

said glasses comprise safety glasses, prescription eyeglasses, or sunglasses.

3. The face mask of claim 1 wherein:

said filter body of said nosepiece comprises an opening extending through said body.

4. The face mask of claim 1 wherein:

said attachment portion is curved inwards along a vertical dimension of said attachment portion.

5. The face mask of claim 1 wherein:

said attachment feature comprises a clip that receives a portion of said bridge in a press fit, friction fit, or snap fit.

6. The face mask of claim 1 wherein:

said filter body comprises at least one of acrylonitrile butadiene styrene (ABS), thermoplastic elastomers (TPE), polylactic acid (PLA), high impact polystyrene (HIPS), polyethylene terephthalate glycol (PET), nylon, carbon fiber, acrylonitrile styrene acrylate (ASA), polycarbonate, polypropylene, metal, wood, and poly(vinyl alcohol) (PVA).

7. The face mask of claim 1 wherein:

said nosepiece is formed by 3D printing.

8. A face mask comprising:

glasses configured to be worn by a user, said glasses comprising a bridge;

a nosepiece comprising:

a filter body configured to receive and cover a nose and a mouth of said user when said face mask is worn;

an attachment portion disposed along a top of said filter body; and an attachment feature configured to securely attach said nosepiece to said bridge of said glasses;

a face shield configured to cover at least a majority of a face of said user when said face mask is worn, said face shield comprising a shield body, an outer rim, and an inner rim, where said nosepiece is attached to said inner rim; and attachment devices for connecting said face shield to said glasses at temple areas of the face shield;

wherein at least a mid-portion of said outer rim is spaced apart from at least a mid-portion of said inner rim; and wherein said inner rim and said outer rim intersect at said temple areas.

9. A face mask comprising:

glasses configured to be worn by a user, said glasses comprising a bridge;

a nosepiece comprising:

a filter body configured to receive and cover a nose and a mouth of said user when said face mask is worn;

an attachment portion disposed along a top of said filter body; and an attachment feature configured to securely attach said nosepiece to said bridge of said glasses;

a face shield connected to said nosepiece and, said face shield comprises:

a transparent body configured to cover at least a majority of a face of said user when said face mask is worn;

clips, spaced apart from one another;

an outer rim attached to said transparent body by way of said clips; and an inner rim, wherein at least a mid-portion of said outer rim is spaced apart from at least a mid-portion of said inner rim, said inner rim is configured to rest against a forehead of said user when said face mask is worn, and said inner rim and said outer rim intersect at temple areas of the face shield; and attachment devices connecting said face shield to said glasses at said temple areas;

wherein said nosepiece is attached to said face shield at said inner rim.

* * * * *